US007635313B2

(12) United States Patent
Isogawa et al.

(10) Patent No.: US 7,635,313 B2
(45) Date of Patent: Dec. 22, 2009

(54) GOLF BALL

(75) Inventors: Kazuhiko Isogawa, Kobe (JP); Keiji Ohama, Kobe (JP); Takahiro Sajima, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/808,685

(22) Filed: Jun. 12, 2007

(65) Prior Publication Data

US 2008/0039236 A1 Feb. 14, 2008

(30) Foreign Application Priority Data

Aug. 10, 2006 (JP) ..... 2006-217699

(51) Int. Cl.
*A63B 37/12* (2006.01)

(52) U.S. Cl. ..... 473/383

(58) Field of Classification Search ..... 473/383–385, 473/378, 373, 374
See application file for complete search history.

(56) References Cited

U.S. PATENT DOCUMENTS

| | | | |
|---|---|---|---|
| 4,729,861 | A | 3/1988 | Lynch et al. |
| 4,813,677 | A | 3/1989 | Oka et al. |
| 4,936,587 | A | 6/1990 | Lynch et al. |
| 5,080,367 | A | 1/1992 | Lynch et al. |
| 5,292,132 | A | 3/1994 | Oka |
| 5,830,085 | A | 11/1998 | Higuchi et al. |
| 6,336,873 | B1 | 1/2002 | Yamagishi et al. |
| 2004/0009831 | A1 | 1/2004 | Ohama et al. |
| 2005/0137032 | A1 | 6/2005 | Aoyama et al. |
| 2006/0025245 | A1 | 2/2006 | Aoyama et al. |

FOREIGN PATENT DOCUMENTS

JP 2000-325499 A 11/2000

*Primary Examiner*—Raeann Trimiew
(74) *Attorney, Agent, or Firm*—Birch, Stewart, Kolasch & Birch, LLP

(57) ABSTRACT

Golf ball 2 has a center 5, a mid layer 6, a cover 4 and numerous dimples 8. A product Pm of a volume Vm multiplied by a flexural rigidity Fm in the mid layer 6 and a product Pc of a volume Vc multiplied by a flexural rigidity Fc in the cover meet the following formulae (I) and (II).

$$1400<(Pm+Pc)<2000 \quad \text{(I)}$$

$$5.0<(Pc/Pm)<7.6 \quad \text{(II)}$$

Provided that mean diameter of all the dimples 8 is Da, a ratio (N1/N) of number N1 of adjacent dimple pairs having a pitch of (Da/4) or less to total number N of the dimples 8 is equal to or greater than 2.70. A ratio (N2/N1) of number N2 of the adjacent dimple pairs having a pitch of (Da/20) or less to the number N1 is equal to or greater than 0.50.

9 Claims, 17 Drawing Sheets

GOLF BALL

This application claims priority on Patent Application No. 2006-217699 filed in JAPAN on Aug. 10, 2006. The entire contents of this Japanese Patent Application are hereby incorporated by reference.

BACKGROUND OF THE INVENTION

1. Field of the Invention

The present invention relates to solid golf balls having a center, a mid layer, a cover and dimples.

2. Description of the Related Art

Golf balls have numerous dimples on the surface thereof. The dimples disrupt the air flow around the golf ball during flight to cause turbulent flow separation. By causing the turbulent flow separation, separating points of the air from the golf ball shift backwards leading to the reduction of a drag. The turbulent flow separation promotes the displacement between the separating point on the upper side and the separating point on the lower side of the golf ball, which results from the backspin, thereby enhancing the lift force that acts upon the golf ball. The reduction of a drag and the enhancement of the lift force are referred to as a "dimple effect". Excellent dimples disturb the air flow more efficiently. Excellent dimples make a great flight distance.

It is known to those skilled in the art that a great dimple effect is obtained in golf balls on which dimples are densely arranged. A variety of proposals for the purpose of enhancement of the dimple effect have been made with respect to dimple patterns.

U.S. Pat. No. 5,080,367 (JP-A-50-8630) discloses a golf ball with numerous dimples having a uniform size. In this golf ball, most dimple pairs have a pitch of smaller than 0.065 inch. In this golf ball, a relationship between a pitch and a dimple diameter is not considered. In comparison with general dimple diameters, the pitch of 0.065 inch is not sufficiently small. In a pattern with dimples having a uniform size, diameters of the dimples can not be set to be great. The dimples of the golf ball are not arranged densely enough.

U.S. Pat. No. 4,813,677 (JP-A-62-192181) discloses a golf ball with large dimples and small dimples. In this golf ball, high density of dimples is achieved by arranging small dimples in a region which is surrounded by multiple large dimples. However, the small dimples are not sufficiently responsible for the dimple effect.

U.S. Pat. No. 5,292,132 (JP-A-4-347177) discloses a golf ball in which dimples are arranged such that any rectangle having a determined size can not be formed on the land. In this golf ball, small proportion of the land is achieved by arranging numerous small dimples. However, the small dimples are not sufficiently responsible for the dimple effect.

The golf players place great importance also on spin performance of golf balls together with flight performance. Great back spin rate results in small run. For golf players, golf balls which are liable to be spun backwards are apt to be rendered to stop at a targeted position. Great side spin rate results in easily curved trajectory of the golf ball. For golf players, golf balls which are liable to be spun sidewise are apt to allow their trajectory to curve intentionally. The golf balls that are excellent in spin performance are excellent in control performance. High-level golf players particularly place great importance on control performance upon shots with a short iron. In addition, the golf players place great importance on feel at impact of golf balls. Control performance and feel at impact depend on a structure of the golf ball. JP-A-2000-225209 discloses a golf ball having a core, an inner cover, an outer cover and dimples with special specification.

Requirements by golf players concerning flight performance, control performance and feel at impact have been escalated. Golf balls still have room to be improved. An object of the present invention is to provide a golf ball that is excellent in performances.

SUMMARY OF THE INVENTION

A golf ball according to the present invention has a center, a mid layer positioned outside of the center, a cover positioned outside of the mid layer and numerous dimples formed on the surface of the cover. A product Pm of a volume Vm ($cm^3$) multiplied by a flexural rigidity Fm (Mpa) in the mid layer and a product Pc of a volume Vc ($cm^3$) multiplied by a flexural rigidity Fc (MPa) in the cover meet the following formulae (I) and (II).

$$1400<(Pm+Pc)<2000 \quad \text{(I)}$$

$$5.0<(Pc/Pm)<7.6 \quad \text{(II)}$$

Provided that mean diameter of all the dimples is Da, a ratio (N1/N) of number N1 of adjacent dimple pairs having a pitch of (Da/4) or less to total number N of the dimples is equal to or greater than 2.70. A ratio (N2/N1) of number N2 of adjacent dimple pairs having a pitch of (Da/20) or less to the number N1 is equal to or greater than 0.50.

In this golf ball, the mid layer and the cover are responsible for resilience performance, the dimples are responsible for aerodynamic characteristic. Owing to synergistic effect of resilience performance and aerodynamic characteristic, a great flight distance is attained with this golf ball. In this golf ball, the mid layer and the cover are also responsible for control performance and feel at impact.

Preferably, a thickness Tm of the mid layer is equal to or less than 1.2 mm, a thickness Tc of the cover is equal to or less than 1.4 mm and a total thickness (Tm+Tc) is equal to or less than 2.4 mm. Preferably, the mid layer has a hardness (Shore D) of 32 or greater and 39 or less.

Preferably, the ratio (N2/N1) is equal to or greater than 0.60. Preferably, the mean diameter Da is equal to or greater than 4.00 mm. Preferably, the total number N of the dimples is equal to or less than 362. Preferably, a proportion of a total area of all dimples to a surface area of a phantom sphere is equal to or greater than 75%.

Preferably, the northern hemisphere and the southern hemisphere of the surface of this golf ball have a pole vicinity region, an equator vicinity region and a coordination region, respectively. This coordination region is located between the pole vicinity region and the equator vicinity region. The dimple pattern in the pole vicinity region includes multiple units. These units are rotationally symmetric to each other centered on the pole point. The dimple pattern in the equator vicinity region includes multiple units. These units are rotationally symmetric to each other centered on the pole point. Number of the units in the pole vicinity region is different from number of the units in the equator vicinity region. The dimple pattern in the coordination region is either a pattern which cannot be comparted into multiple units that are rotationally symmetric to each other centered on the pole point, or a pattern including multiple units that are rotationally symmetric to each other centered on the pole point with number of the units being different from the numbers of the units in the pole vicinity region and the equator vicinity region.

It is preferred that any great circle that does not cross the dimple is not present on the surface of this golf ball.

DESCRIPTION OF THE PREFERRED EMBODIMENTS

The present invention will be hereinafter described in detail with appropriate references to the accompanying drawing according to preferred embodiments.

Figure 1:
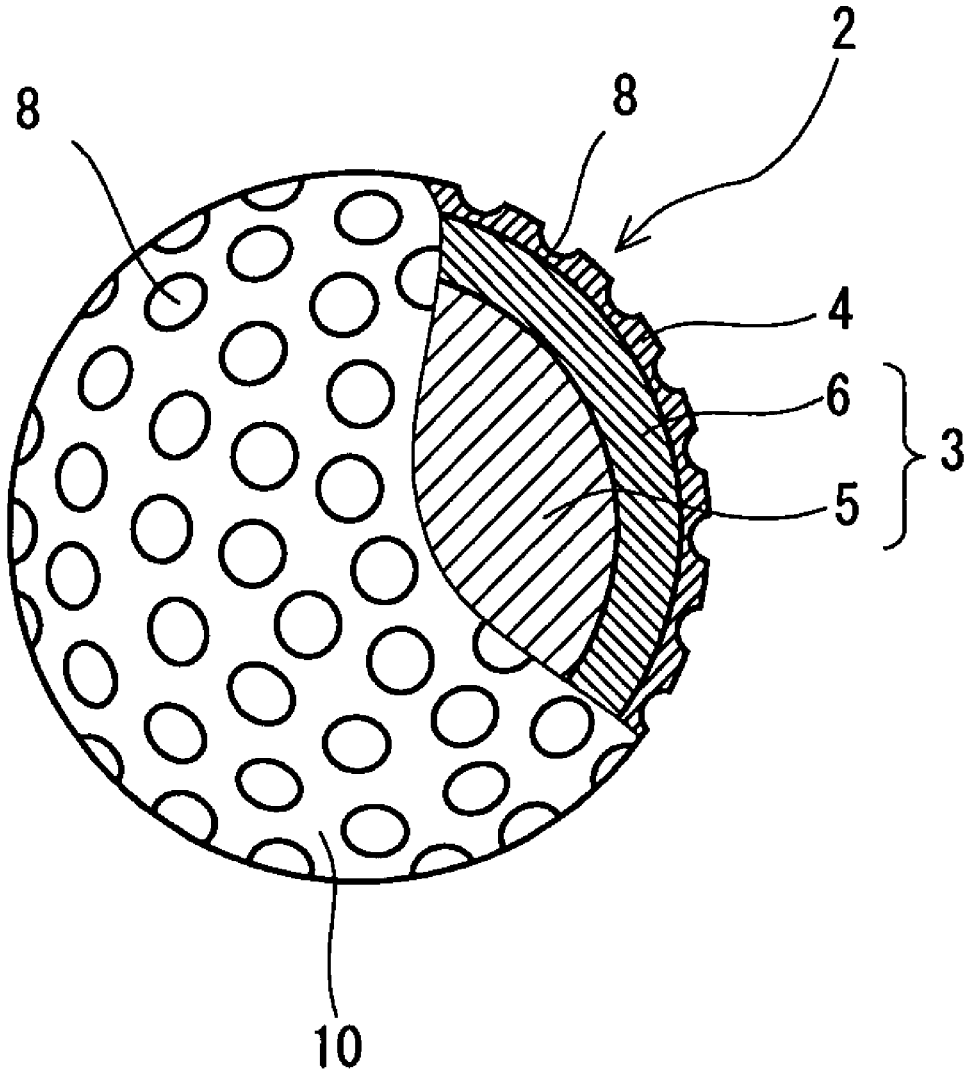
FIG. 1 is a schematic cross-sectional view illustrating a golf ball according to one embodiment of the present invention.

Golf ball 2 shown in FIG. 1 has a spherical core 3 and a cover 4 covering this core 3. The core 3 has a spherical center 5, a mid layer 6 covering this center 5. On the surface of the cover 4, numerous dimples 8 are formed. Of the surface of the golf ball 2, a part except for the dimples 8 is a land 10. The golf ball 2 has a paint layer and a mark layer to the external side of the cover 4 although these layers are not shown in the Figure. The center 5 may have a non-spherical shape. The center 5 may have a rib.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is particularly preferably equal to or less than 45.93 g.

The center 5 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. In light of resilience performance, polybutadienes are preferred. When other rubber is used in combination with a polybutadiene, it is preferred that polybutadiene is included as a principal component. Specifically, a proportion of polybutadiene in the entire base rubber is preferably equal to or greater than 50% by weight, and particularly preferably equal to or greater than 80% by weight. A polybutadiene having a proportion of cis-1,4 bonds of equal to or greater than 40 mol %, and further, equal to or greater than 80 mol % is preferred.

A polybutadiene synthesized using a rare earth element catalyst is particularly preferred. By using this polybutadiene, excellent resilience performance of the golf ball 2 can be achieved. Examples of rare earth element catalysts include lanthanum series rare earth element compound, organoaluminum compound, and almoxane and halogen containing compound. A lanthanum series rare earth element compound is preferred. Examples of lanthanum series rare earth element compounds include halide, carboxylate, alcoholate, thioalcoholate and amide of lanthanide having atomic numbers from 57 to 71. Neodymium catalyst (catalyst containing neodymium compound) is particularly preferred. When polymerizing, a molar ratio of a butadiene to a lanthanum series rare earth element compound is preferably equal to or greater than 1000/1, particularly preferably equal to or greater than 5000/1. The molar ratio is preferably equal to or less than 2000000/1, particularly preferably equal to or less than 1000000/1.

It is still preferred that polybutadienes synthesized using a rare earth element catalyst are denatured by a compound having an alkoxysilyl group. The denatured polybutadienes have a proportion of cis-1,4 bonds of equal to or greater than 90 mol %. By this denatured polybutadienes, excellent resilience performance of golf ball 2 is achieved.

Examples of compounds having an alkoxysilyl group include alkoxysilane compound containing an epoxy group or an isocyanate group. Specific examples of alkoxysilane compound containing an epoxy group include 3-glycidiloxypropyltrimethoxysilane, 3-glycidiloxypropyltriethoxysilane, (3-glycidiloxypropyl)methyldimethoxysilane, (3-glycidiloxypropyl)methyldiethoxysilane, β-(3,4-epoxycyclohexyl)trimethoxysilane, β-(3,4-epoxycyclohexyl)triethoxysilane, β-(3,4-epoxycyclohexyl) methyldimethoxysilane, β-(3,4-epoxycyclohexyl) ethyldimethoxysilane, a condensate of 3-glycidiloxypropyltrimethoxysilane, and a condensate of (3-glycidiloxypropyl)methyldimethoxysilane. Specific examples of alkoxysilane compound containing an isocyanate group include 3-isocyanatepropyltrimethoxysilane, 3-isocyanatepropyltriethoxysilane, (3-isocyanatepropyl)methyldimethoxysilane, (3-isocyanatepropyl) methyldiethoxysilane, a condensate of 3-isocyanatepropyltrimethoxysilane, and a condensate of (3-isocyanatepropyl)methyldimethoxysilane.

This denatured polybutadiene has a ratio (Mw/Mn) of weight average molecular weight Mw and number average molecular weight Mn is 1.0 to 3.5, particularly 1.0 to 3.3. This denatured polybutadiene has a mooney viscosity $ML_{1+4}$ (100° C.) of 30 to 100, particularly 50 to 90.

In the rubber composition for the center 5, a co-crosslinking agent is included. Preferable examples of co-crosslinking agent in light of resilience performance include monovalent or bivalent metal salts of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

The amount of the co-crosslinking agent to be blended is preferably 20 parts by weight or greater and 55 parts by weight or less per 100 parts by weight of the base rubber. By setting the amount to be equal to or greater than 20 parts by weight, excellent resilience performance can be achieved. In this respect, the amount is more preferably equal to or greater than 25 parts by weight, and particularly preferably equal to or greater than 30 parts by weight. By setting the amount to be equal to or less than 55 parts by weight, excellent feel at impact can be achieved. In this respect, the amount is more preferably equal to or less than 50 parts by weight.

Preferably, the rubber compound of the center 5 includes an organic peroxide together with a co-crosslinking agent. The organic peroxide serves as a crosslinking initiator. The organic peroxide is responsible for resilience performance. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. By setting the amount to be equal to or greater than 0.1 part by weight, excellent resilience performance can be achieved. In this respect, the amount is more preferably equal to or greater than 0.3 part by weight, and particularly preferably equal to or greater than 0.5 part by weight. By setting the amount to be equal to or less than 3.0 parts by weight, excellent feel at impact can be achieved. In this respect, the amount is more preferably equal to or less than 2.8 parts by weight, and particularly preferably equal to or less than 2.5 parts by weight.

Preferably, the rubber composition of the center 5 includes an organic sulfur compound. By the organic sulfur compound, excellent resilience performance of the golf ball 2 can be achieved. Illustrative examples of preferable organic sulfur compound include monosubstitution such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl) disulfide and bis(4-cyanophenyl)disulfide; disubstitution such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitution such as bis(2,4,6-trichlorophenyl)disulfide and bis(2-cyano-4-chloro-6-bromophenyl)disulfide; tetrasubstitution such as bis(2,3,5,6-tetrachlorophenyl)disulfide; and pentasubstitution such as bis (2,3,4,5,6-pentachlorophenyl)disulfide and bis(2,3,4,5,6-pentabromophenyl)disulfide. Particularly preferable organic sulfur compound is diphenyl disulfide and bis(pentabromophenyl)disulfide.

In light of resilience performance of the golf ball 2, the amount of the organic sulfur compound to be blended is preferably equal to or greater than 0.01 part by weight, more preferably equal to or greater than 0.05 part by weight, and particularly preferably equal to or greater than 0.1 part by weight per 100 parts by weight of the base rubber. In light of soft feel at impact, the amount of the organic sulfur compound to be blended is preferably equal to or less than 5 parts by weight, more preferably equal to or less than 4 parts by weight, and particularly preferably equal to or less than 3 parts by weight per 100 parts by weight of the base rubber.

Into the center 5 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the center 5 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended at an adequate amount to the center 5 as needed. Into the center 5 may be also blended crosslinked rubber powder or synthetic resin powder.

The center 5 has an amount of compressive deformation of preferably 2.3 mm or greater and 5.0 mm or less. By the center 5 having an amount of compressive deformation of equal to or greater than 2.3 mm, excellent feel at impact can be achieved. In this respect, the amount of compressive deformation is particularly preferably equal to or greater than 3.5 mm. By the center 5 having an amount of compressive deformation of equal to or less than 5.0 mm, excellent resilience performance can be achieved. In this respect, the amount of compressive deformation is particularly preferably equal to or less than 4.6 mm.

Upon measurement of the amount of compressive deformation, the spherical body (center 5, core 3 or golf ball 2) is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which initial load of 98 N is applied to the spherical body up to the state in which final load of 1274 N is applied thereto is the amount of compressive deformation.

From a standpoint that the center 5 is sufficiently responsible for resilience performance, the center 5 has a diameter of preferably equal to or greater than 30 mm, particularly preferably equal to or greater than 32 mm. From a standpoint that the mid layer 6 and the cover 4 are sufficiently responsible for durability and deformation behavior, the center 5 has a diameter of preferably equal to or less than 41.0 mm, and particularly preferably equal to or less than 40.5 mm. Crosslinking temperature of the center 5 is 140° C. or greater and 180° C. or less. The crosslinking time period of the center 5 is usually 10 minutes or longer and 60 minutes or less. The center 5 may be formed with two or more layers.

The mid layer 6 is formed by a thermoplastic resin composition. Examples of the base polymer of this resin composition include ionomer resins, styrene block-containing thermoplastic elastomers, thermoplastic polyester elastomers, thermoplastic polyamide elastomers, thermoplastic polyurethane elastomers and thermoplastic polyolefin elastomers. In particular, ionomer resins and styrene block-containing thermoplastic elastomers are preferably used in combination. Ionomer resins are highly elastic. By the ionomer resins, excellent resilience performance of the golf ball 2 can be achieved. Styrene block-containing thermoplastic elastomers are soft. By the styrene block-containing thermoplastic elastomers, excellent feel at impact of the golf ball 2 is achieved.

Examples of preferable ionomer resin include binary copolymers formed with α-olefin and an α,β-unsaturated carboxylic acid having 3 to 8 carbon atoms. Preferable binary copolymer includes 80% by weight or more and 90% by weight or less α-olefin, and 10% by weight or more and 20% by weight or less α,β-unsaturated carboxylic acid. This binary copolymer provides excellent resilience performance. Examples of preferable other ionomer resin include ternary copolymers formed with α-olefin, an α,β-unsaturated carboxylic acid having 3 to 8 carbon atoms and an α,β-unsaturated carboxylate ester having 2 to 22 carbon atoms. Preferable ternary copolymer includes 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. In the binary copolymer and ternary copolymer, preferable α-olefin may be ethylene and propylene, while preferable α,β-unsaturated carboxylic acid may be acrylic acid and methacrylic acid. Particularly preferred ionomer resin is a copolymer formed with ethylene, and acrylic acid or methacrylic acid.

In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329" and "Himilan MK7320", available from Du Pont-MITSUI POLYCHEMICALS Co., Ltd.; trade names "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945" and "Surlyn® AD8546", available from Dupont; and trade names "IOTEK 7010", "IOTEK 7030", "IOTEK 7510", "IOTEK 7520", "IOTEK 8000" and "IOTEK 8030", available from EXXON Mobil Chemical Corporation. Two or more kinds of the ionomer resin may be used in combination. An ionomer resin neutralized with a monovalent metal ion, and an ionomer resin neutralized with a bivalent metal ion may be used in combination.

Styrene block-containing thermoplastic elastomers include a polystyrene block as a hard segment and a soft segment. Typical soft segment is a diene block. Examples of the styrene block-containing thermoplastic elastomer include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS may include styrene-ethylene-butylene-styrene block copolymers (SEBS) Exemplary hydrogenated SIS may include styrene-ethylene-propylene-styrene block copolymers (SEPS) Exemplary hydrogenated SIBS may include styrene-ethylene-ethylene-propylene-styrene block copolymers (SEEPS).

In light of resilience performance of the golf ball 2, content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, the styrene block-containing thermoplastic elastomer may include alloys of olefin and one or two or more selected from the group consisting of SBS, SIS, SIBS, SEBS, SEPS and SEEPS, and hydrogenated products thereof. The olefin component in the alloy is presumed to contribute to the improvement of compatibility with ionomer resins. Use of this alloy may improve resilience performance of the golf ball 2. Preferably, an olefin having 2 to 10 carbon atoms may be used. Illustrative examples of suitable olefin include ethylene, propylene, butane and pentene. Ethylene and propylene are particularly preferable.

Specific examples of polymer alloys include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N" and"Rabalon® SR04", trade names by Mitsubishi Chemical Corporation. Other specific examples of the styrene block-containing thermoplastic elastomer include "Epofriend® A1010", a trade name by Daicel Chemical Industries; and "Septon HG-252", a trade name by Kuraray Co., Ltd.

In light of resilience performance, a proportion of the ionomer resin to the total base polymer is preferably equal to or greater than 30% by weight, more preferably equal to or greater than 40% by weight, and particularly preferably equal to or greater than 45% by weight. The proportion is preferably equal to or less than 80% by weight.

In light of feel at impact, a proportion of the styrene block-containing thermoplastic elastomer to the total base polymer is preferably equal to or greater than 20% by weight, more preferably equal to or greater than 25% by weight, and particularly preferably equal to or greater than 30% by weight. The proportion is preferably equal to or less than 70% by weight.

The resin composition in the mid layer 6 contains a metal oxide with a three-dimensional shape. This metal oxide has three or more needle-like parts. The three-dimensional shape means a shape in which a plane including an axis of a first needle-like part and an axis of a second needle-like part, does not include an axis of a third needle-like part.

Figure 2:
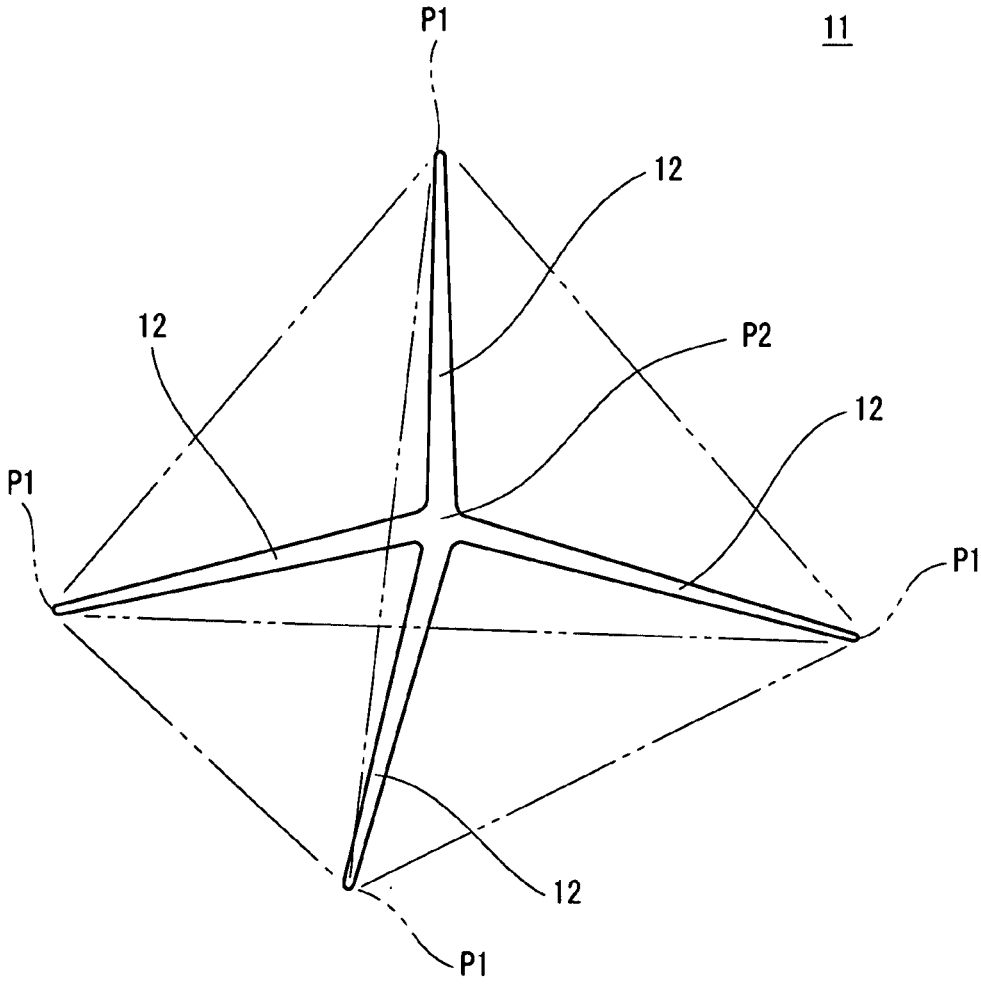
FIG. 2 is a perspective view illustrating a metal oxide which is blended in the golf ball shown in FIG. 1.

In FIG. 2, a favorable metal oxide 11 is depicted. This metal oxide 11 has four needle-like parts 12, each having one of four apices P1 of a triangular pyramid as an end. Another end of all the four needle-like parts 12 is positioned at a point P2 existing inside of the triangular pyramid. From the point P2, four axes extend to the four apices P1 of the triangular pyramid. The metal oxide 11 has a similar shape to a Tetrapod (registered trademark). Preferably, the metal oxide 11 is needle-like crystal. Preferably, the triangular pyramid is a regular tetrahedron and the other ends of the needle-like parts 12 are positioned at the center of the regular tetrahedron. A length of the four needle-like parts 12 is substantially the same.

Illustrative examples of the metal oxide 11 which can have a three-dimensional shape include zinc oxide, titanium oxide, barium sulfate and talc. Preferable metal oxide 11 is zinc oxide. Specific examples of preferable metal oxide 11 include zinc oxide available from MATSUSHITA ELECTRONIC INDUSTRIAL CO., LTD. (trade name "Panatetra" (registered trademark)). This zinc oxide has a shape shown in FIG. 2.

By the metal oxide 11 with a three-dimensional shape being dispersed in the base resin, the mid layer 6 is reinforced. When molding the mid layer 6, the resin composition flows. Especially when molding the mid layer 6 with injection molding, the resin composition flows remarkably. When the metal oxide 11 has a three-dimensional shape, the metal oxide 11 is not oriented even if the resin composition flows. In this mid layer 6, durability is not deteriorated by the orientation. The mid layer 6 is responsible for durability of the golf ball 2. The golf ball 2 having thin cover 4 or thin mid layer 6 is easily damaged by being hit repeatedly. By the metal oxide 11 with a three-dimensional shape being dispersed in the mid layer 6, the damage is restrained even if the cover 4 or the mid layer 6 of the golf ball 2 is thin.

A mean length of the needle-like parts 12 of the metal oxide 11 is preferably 5 μm or greater and 50 μm or less. The metal oxide 11 with the mean length of equal to or greater than 5 μm is responsible for rigidity of the mid layer 6. In this respect, the mean length is more preferably equal to or greater than 7 μm. The metal oxide 11 with the mean length of equal to or less than 50 μm is responsible for dispersibility. In this respect, the mean length is particularly preferably equal to or less than 40 μm.

When the amount of the metal oxide 11 to be blended is too small, reinforcing effect is insufficient and durability is insufficient. When the amount is too large, durability is also insufficient due to brittleness of the mid layer 6. In light of durability, the amount of the metal oxide 11 with a three-dimensional shape to be blended is preferably equal to or greater than 0.3 part by weight, more preferably equal to or greater than 0.5 part by weight, and particularly preferably equal to or greater than 5 parts by weight per 100 parts by weight of the base resin. In light of durability, the amount is preferably equal to or less than 20 parts by weight, more preferably equal to or less than 17 parts by weight, and particularly preferably equal to or less than 15 parts by weight.

When general fillers are blended, rigidity of the mid layer 6 is enhanced and at the same time hardness of the mid layer 6 is also enhanced. Increase of rigidity is responsible for resilience performance. On the other hand, feel at impact is deteriorated by the increase of rigidity. Because the metal oxide 11 with a three-dimensional shape has a great reinforcing effect, rigidity is sufficiently increased by blending the metal oxide 11. Even if the amount of the metal oxide 11 to be blended is small, great resilience performance is achieved. The small amount to be blended does not greatly increase hardness of the mid layer 6. By blending this metal oxide 11, both of resilience performance and feel at impact can be achieved. The low hardness is responsible for reduction of the spin.

Into the resin composition of the mid layer 6 may be blended a filler such as barium sulfate, a coloring agent such as titanium dioxide, and additives such as a dispersant, an anti-aging agent, an ultraviolet absorbent and the like.

In light of resilience performance, the mid layer 6 has a hardness of preferably equal to or greater than 25, more preferably equal to or greater than 30, and particularly preferably equal to or greater than 32. In light of feel at impact, the hardness is preferably equal to or less than 45, more preferably equal to or less than 42, and particularly preferably equal to or less than 39.

In the present invention, hardness of the mid layer 6 and the cover 4 is measured in accordance with a standard of "ASTM-D 2240-68". For the measurement, an automated rubber hardness machine (trade name "P1", available from Koubunshi Keiki Co., Ltd.) which is equipped with a Shore D type spring hardness scale is used. Upon measurement, slabs formed by hot press and having a thickness of about 2 mm are used. Slabs which are stored at a temperature of 23° C. for two weeks are used for the measurement. When measuring, three slabs are overlaid. For the measurement of hardness of the mid layer 6, slabs which are formed by the same material as used in the mid layer 6 are used. For the measurement of hardness of the cover 4, slabs which are formed by the same material as used in the cover 4 are used.

In light of resilience performance, the mid layer 6 has a flexural rigidity Fm of preferably equal to or greater than 25 MPa, particularly preferably equal to or greater than 35 MPa. In light of feel at impact, the flexural rigidity Fm is preferably equal to or less than 100 MPa, particularly preferably equal to or less than 73 MPa.

In the present invention, flexural rigidity of the mid layer 6 and the cover 4 is measured in accordance with a standard of "JIS K7106". Upon measurement, slabs formed by hot press and having a thickness of about 2 mm are used. Slabs which are stored at a temperature of 23° C. for two weeks are used for the measurement. For the measurement of flexural rigidity Fm of the mid layer 6, slabs which are formed by the same material as used in the mid layer 6 are used. For the measurement of flexural rigidity of the cover 4, slabs which are formed by the same material as used in the cover 4 are used.

The mid layer 6 has a thickness Tm of preferably equal to or less than 1.2 mm. This mid layer 6 is thin. By the thin mid layer 6, a great launch angle can be achieved. By the great launch angle, a great flight distance is obtained. In this respect, the thickness Tm is more preferably equal to or less than 1.1 mm, particularly equal to or less than 1.0 mm. In light of feel at impact, the thickness Tm is preferably equal to or greater than 0.6 mm, more preferably equal to or greater than 0.7 mm, and particularly preferably equal to or greater than 0.8 mm.

In light of feel at impact, the mid layer 6 has a volume Vm of preferably equal to or greater than 2.85 $cm^3$, and particularly preferably equal to or greater than 3.30 $cm^3$. In light of launch angle, the volume Vm is preferably equal to or less than 7.35 $cm^3$, and particularly equal to or less than 6.10 $cm^3$. The volume Vm of the mid layer 6 is calculated by subtracting volume of the center 5 from volume of the core 3.

The cover 4 is formed by a thermoplastic resin composition. Examples of the base polymer of this resin composition include ionomer resins, styrene block-containing thermoplastic elastomers, thermoplastic polyester elastomers, thermoplastic polyamide elastomers, thermoplastic polyurethane elastomers and thermoplastic polyolefin elastomers. In particular, ionomer resins are preferred. Ionomer resins are highly elastic. By using the ionomer resins, excellent resilience performance of the golf ball 2 can be achieved. The ionomer resins which can be used for the mid layer 6 can also be used for the cover 4.

The ionomer resin and other resin may be used in combination. When they are used in combination, the ionomer resin is included as a principal component of the base polymer, in light of resilience performance. A proportion of the ionomer resin in the total base polymer accounts for preferably equal to or greater than 80% by weight, more preferably equal to or greater than 85% by weight, and particularly preferably equal to or greater than 90%.

In light of excellent compatibility with the ionomer resin, it is preferable that the styrene block-containing thermoplastic elastomer is used in combination. The styrene block-containing thermoplastic elastomer is responsible for feel at impact and strength of the golf ball 2. The styrene block-containing thermoplastic elastomer which can be used for the mid layer 6 can also be used for the cover 4. In light of feel at impact, a proportion of the styrene block-containing thermoplastic elastomer in the total base polymer accounts for preferably equal to or greater than 1% by weight, more preferably equal to or greater than 2% by weight, and particularly preferably equal to or greater than 3% by weight. In light of resilience performance, the proportion is preferably equal to or less than 20% by weight, more preferably equal to or less than 15% by weight, and particularly preferably equal to or less than 10% by weight.

The resin composition in the cover 4 contains a metal oxide with a three-dimensional shape. In particular, the metal oxide 11 shown in FIG. 2 is preferred. This metal oxide 11 is responsible for durability of the cover 4. By this metal oxide 11, both resilience performance and feel at impact of the golf ball 2 can be achieved. The amount of the metal oxide 11 to be blended is preferably equal to or greater than 0.3 part by weight, more preferably equal to or greater than 0.5 part by weight, and particularly preferably equal to or greater than 5 parts by weight per 100 parts by weight of the base resin. The amount of the metal oxide 11 to be blended is preferably equal to or less than 20 parts by weight, more preferably equal to or less than 17, and particularly preferably equal to or less than 15 parts by weight.

Into the resin composition of the cover 4 may be blended a filler such as barium sulfate, a coloring agent such as titanium dioxide, and additives such as a dispersant, an anti-aging agent, an ultraviolet absorbent and the like.

In light of resilience performance, the cover 4 has a hardness of equal to or greater than 55, more preferably equal to or greater than 57, and particularly preferably equal to or greater than 59. In light of feel at impact, the hardness is preferably equal to or less than 70, and particularly preferably equal to or less than 65.

In light of resilience performance, the cover 4 has a flexural rigidity Fc of preferably equal to or greater than 160 MPa, and particularly preferably equal to or greater than 190 MPa. In light of feel at impact, the flexural rigidity Fc is preferably equal to or less than 360 MPa, and particularly preferably equal to or less than 320 MPa.

The cover 4 has a thickness Tc of preferably equal to or less than 1.4 mm. This cover 4 is thin. By the thin cover, a great launce angle can be achieved. By the great launch angle, a great flight distance is obtained. In this respect, the thickness Tc is particularly preferably equal to or less than 1.3 mm. In light of ease in forming, the thickness Tc is preferably equal to or greater than 0.3 mm, and particularly preferably equal to or greater than 0.5 mm.

In light of ease in forming, the cover 4 has a volume Vc of preferably equal to or greater than 1.84 $cm^3$, and particularly preferably equal to or greater than 5.30 $cm^3$. In light of launce angle, the volume Vc is preferably equal to or less than 9.85 $cm^3$, and particularly preferably equal to or less than 7.90 $cm^3$. The volume Vc of the cover 4 is calculated by subtracting volume of the core 3 from volume of the golf ball 2. As a matter of convenience, a volume of an after-mentioned phantom sphere 13 is set to be a volume of the golf ball 2.

A total thickness (Tm+Tc) of the thickness Tm of the mid layer 6 and the thickness Tc of the cover 4 is preferably equal to or less than 2.4 mm. In the golf ball 2 having a thickness (Tm+Tc) of equal to or less than 2.4 mm, a great launce angle can be achieved. In this respect, the thickness (Tm+Tc) is particularly preferably equal to or less than 2.3 mm. In light of durability, the thickness (Tm+Tc) is preferably equal to or greater than 1.8 mm.

In the present invention, a value Pm means a product of the volume Vm ($cm^3$) multiplied by the flexural rigidity Fm (MPa), a value Pc means a product of the volume Vc ($cm^3$) multiplied by the flexural rigidity Fc (MPa). In this golf ball 2, a value (Pm+Pc) is greater than 1400 and less than 2000. The golf ball 2 having the value (Pm+Pc) of greater than 1400 is excellent in resilience performance. In this respect, the value (Pm+Pc) is more preferably greater than 1450, and particularly preferably greater than 1500. When the golf ball 2 having the value (Pm+Pc) of less than 2000 is hit by a short iron, great spin rate is obtained. The golf ball 2 having the value (Pm+Pc) of less than 2000 is excellent in control performance. In this respect, the value (Pm+Pc) is particularly preferably smaller than 1950.

In this golf ball 2, a value (Pc/Pm) is greater than 5.0 and less than 7.6. In the golf ball 2 having the value (Pc/Pm) of greater than 5.0, both resilience performance resulting from the cover 4 and feel at impact resulting from the mid layer 6 are achieved. In this respect, the value (Pc/Pm) is preferably greater than 5.5, and particularly preferably greater than 5.8. In the golf ball 2 having the value (Pc/Pm) of less than 7.6, both control performance resulting from the cover 4 and resilience performance resulting from the mid layer 6 are achieved. In this respect, the value (Pc/Pm) is more preferably less than 7.5, and particularly preferably less than 7.4.

The golf ball 2 has an amount of compressive deformation of preferably 2.1 mm or greater and 3.8 mm or less. The golf ball 2 having the amount of compressive deformation of equal to or greater than 2.1 mm is excellent in feel at impact. In this respect, the amount of compressive deformation is more preferably equal to or greater than 2.3 mm, and particularly preferably equal to or greater than 2.4 mm. The golf ball 2 having the amount of compressive deformation of equal to or less than 3.8 mm is excellent in resilience performance. In this respect, the amount of compressive deformation is more preferably equal to or less than 3.5 mm, and particularly preferably equal to or less than 3.2 mm.

Figure 3:
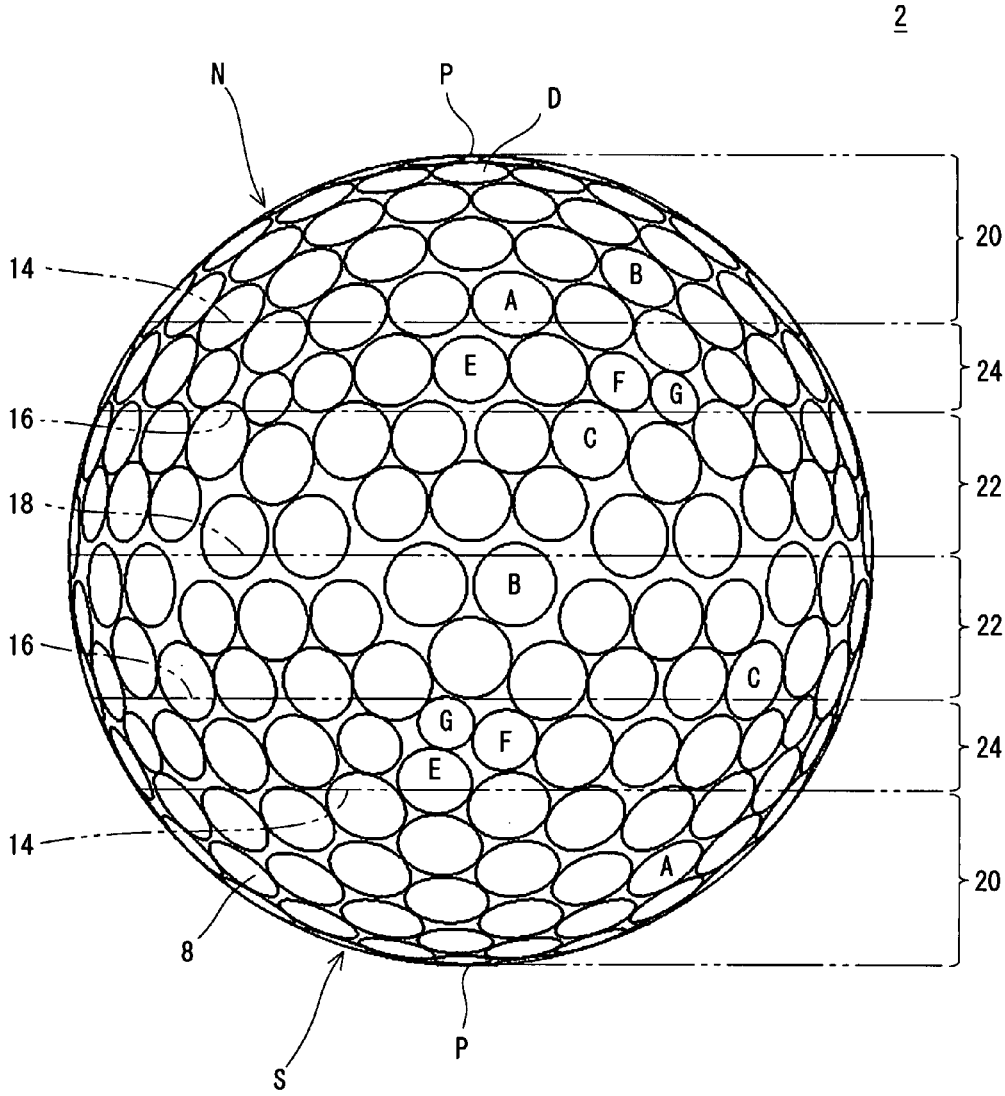
FIG. 3 is an enlarged front view illustrating the golf ball shown in FIG. 1.

FIG. 3 shows an enlarged front view illustrating the golf ball 2 shown in FIG. 1. In FIG. 3, types of the dimples 8 are indicated by the reference signs A to G. All dimples 8 have a plane shape of circular. This golf ball 2 has dimples A having a diameter of 4.5 mm, dimples B having a diameter of 4.4 mm, dimples C having a diameter of 4.3 mm, dimples D having a diameter of 4.1 mm, dimples E having a diameter of 4.0 mm, dimples F having a diameter of 3.5 mm, and dimples G having a diameter of 3.0 mm. Number of the dimples A is 60; number of the dimples B is 86; number of the dimples C is 56; number of the dimples D is 10; number of the dimples E is 76; number of the dimples F is 22; and number of the dimples G is 18. Total number of the dimples 8 is 328. Mean diameter Da is 4.16 mm.

Figure 4:
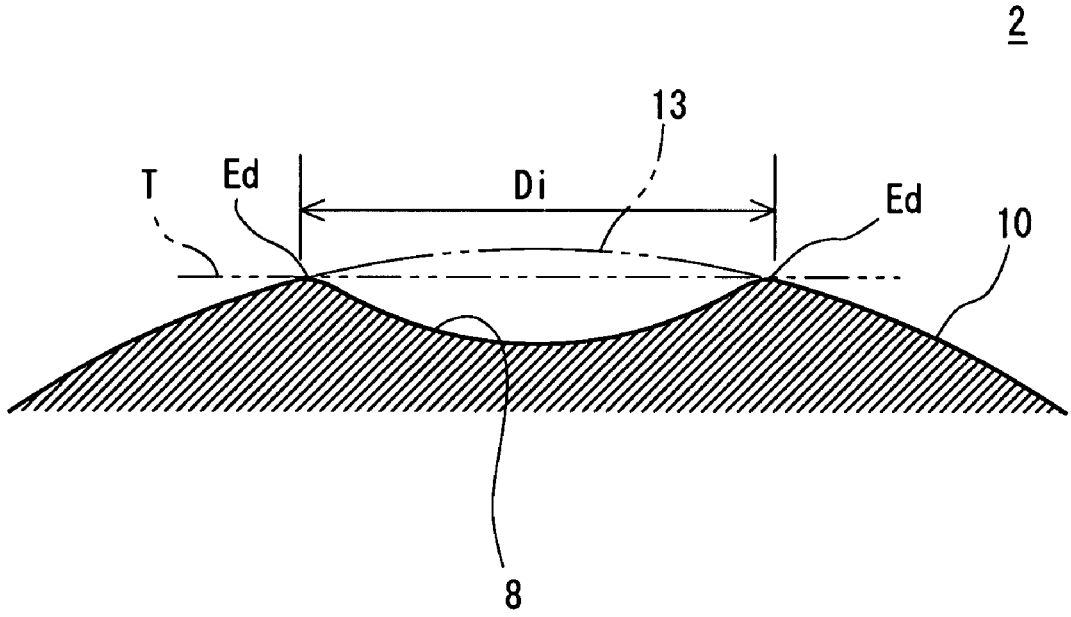
FIG. 4 is an enlarged cross-sectional view illustrating a part of the golf ball shown in FIG. 1.

FIG. 4 shows an enlarged cross-sectional view illustrating a part of the golf ball 2 shown in FIG. 1. In this FIG. 4, a cross section along a plane passing through the center (deepest part) of the dimple 8 and the center of the golf ball 2 is shown. A top-to-bottom direction in FIG. 4 is an in-depth direction of the dimple 8. What is indicated by a chain double-dashed line 13 in FIG. 4 is a phantom sphere. The phantom sphere 13 corresponds to the surface of the golf ball 2 when it is postulated that there is no dimple 8 that exists. The dimple 8 is recessed from the phantom sphere 13. The land 10 agrees with the phantom sphere 13.

In FIG. 4, what is indicated by a both-oriented arrowhead Di is a diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 2.00 mm or greater and 6.00 mm or less. By setting the diameter Di to be equal to or greater than 2.00 mm, great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, fundamental feature of the golf ball 2 which is substantially a sphere is not impaired. In this respect, the diameter Di is more preferably equal to or less than 5.80 mm, and particularly preferably equal to or less than 5.60 mm.

Figure 5:
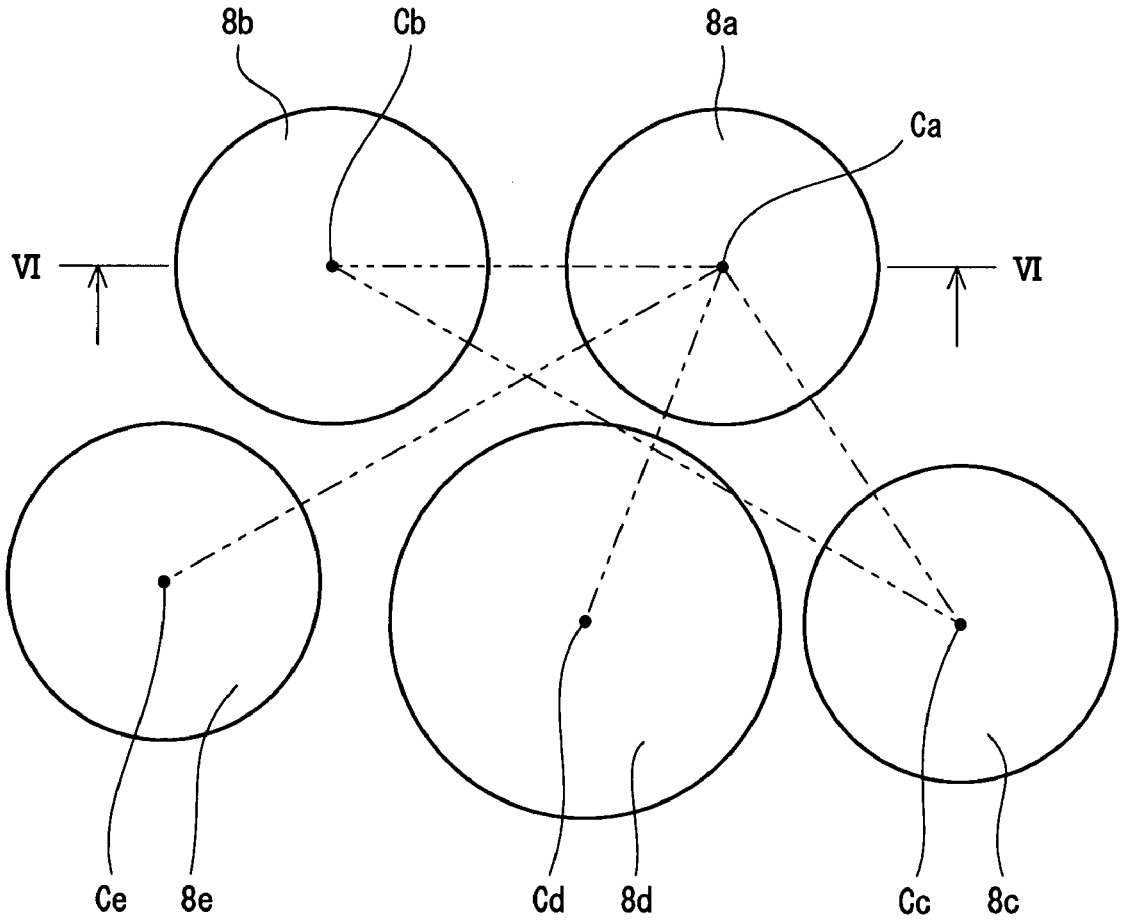
FIG. 5 is an enlarged front view illustrating a part of the golf ball shown in FIG. 3.

FIG. 5 shows an enlarged front view illustrating a part of the golf ball 2 shown in FIG. 3. In this FIG. 5, dimple 8*a*, dimple 8*b*, dimple 8*c*, dimple 8*d* and dimple 8*e* are illustrated. A plane along a line VI-VI in FIG. 5 passes through the center of the dimple 8*a* and the center of the dimple 8*b*.

Figure 6:
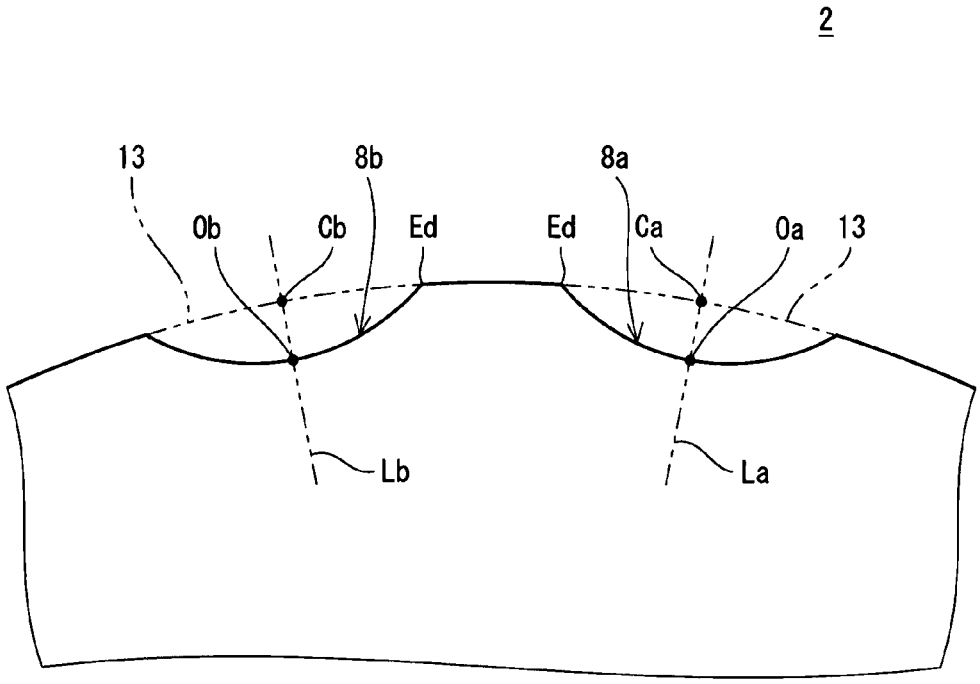
FIG. 6 is a cross-sectional view taken along a line VI-VI of FIG. 5.

FIG. 6 shows a cross-sectional view taken along a line VI-VI of FIG. 5. In FIG. 6, what is indicated by reference sign Oa is the center of the dimple 8*a*, and what is indicated by reference sign Ob is the center of the dimple 8*b*. What is indicated by reference sign Ca is an intersecting point of line La passing the center Oa and extending in a radial direction of the golf ball 2 with the phantom sphere 13. What is indicated by reference sign Cb is an intersecting point of line Lb passing the center Ob and extending in a radial direction of the golf ball 2 with the phantom sphere 13. The circular arc provided by connecting the point Ca and the point Cb is referred to as "joint arc". The joint arc is present on the surface of the phantom sphere 13. The joint arc is a part of the great circle. The joint arc does not cross other dimple 8. Herein, a dimple pair the joint arc of which does not cross other dimple 8 is referred to as "adjacent dimple pair". The dimple 8*a* and the dimple 8*b* construct an adjacent dimple pair. The edge Ed of the dimple 8*a* is positioned on the joint arc (Ca-Cb). Also the edge Ed of the dimple 8*b* is positioned on the joint arc (Ca-Cb). The circular arc (Ed-Ed) is a part of the joint arc (Ca-Cb). The length of the circular arc (Ed-Ed) corresponds to the pitch of the adjacent dimple pair (8*a*-8*b*). When the dimple 8*a* is away from the dimple 8*b*, the value of the pitch is positive. When the dimple 8*a* is in contact with the dimple 8*b*, the value of the pitch is zero. When the dimple 8*a* crosses the dimple 8*b*, the value of the pitch is zero.

As is clear from FIG. 5, the joint arc (Ca-Cc) does not cross other dimples, 8. The dimple 8*a* and the dimple 8*c* construct an adjacent dimple pair. The joint arc (Ca-Cd) does not cross other dimples 8. The dimple 8*a* and the dimple 8*d* construct an adjacent dimple pair. The joint arc (Ca-Ce) does not cross other dimples 8. The dimple 8*a* and the dimple 8*e* construct an adjacent dimple pair. The joint arc (Cb-Cc) crosses the dimple 8*d*. Thus, pair of the dimple 8*b* and the dimple 8*c* is not the adjacent dimple pair.

This golf ball 2 has 1382 adjacent dimple pairs. Among them, 914 adjacent dimple pairs have a pitch of equal to or less than (Da/4), and 546 adjacent dimple pairs have a pitch of equal to or less than (Da/20). The pitch of equal to or less than (Da/20) is extremely small in comparison with the mean diameter Da. In this golf ball 2, ratio (N1/N) of number N1 of the adjacent dimple pairs having a pitch of (Da/4) or less to the total number N of the dimples 8 is 2.79. In this golf ball 2, ratio (N2/N1) of number N2 of the adjacent dimple pairs having a pitch of (Da/20) or less to the number N1 is 0.60.

The ratio (N1/N) is preferably equal to or greater than 2.70, and the ratio (N2/N1) is preferably equal to or greater than 0.50. In other words, it is preferred that the golf ball 2 meets the following formulae (I) and (II):

$$(N1/N) \geqq 2.70 \quad \text{(I)},$$

$$(N2/N1) \geqq 0.50 \quad \text{(II)}.$$

In the present invention, when the numbers N1 and N2 are calculated, the pitch is compared with the mean diameter Da. According to conventional golf balls having numerous small dimples arranged in order to achieve high density, the values of (N1/N) and (N2/N1) are small. To the contrary, in the golf ball 2 which meets the above formulae (I) and (II), the dimples 8 are arranged in an extremely dense manner, and the number of small dimples 8 is low. In this golf ball 2, individual dimples 8 can be responsible for the dimple effect. This golf ball 2 is excellent in flight performance.

In light of flight performance, the ratio (N1/N) is preferably equal to or greater than 2.75, and particularly preferably equal to or greater than 2.90. The ratio (N1/N) is preferably equal to or less than 4.00. In light of flight performance, the ratio (N2/N1) is more preferably equal to or greater than 0.54, still more preferably equal to or greater than 0.60, and particularly preferably equal to or greater than 0.64. The ratio (N2/N1) is equal to or less than 1.00.

In light of achievement of the dimple effect of the individual dimples 8, the mean diameter Da is preferably equal to or greater than 4.00 mm, more preferably equal to or greater than 4.10 mm, and particularly preferably equal to or greater than 4.15 mm. The mean diameter Da is preferably equal to or less than 5.50 mm. By setting the mean diameter Da to be equal to or less than 5.50 mm, fundamental feature of the golf ball 2 which is substantially a sphere is not imparied.

Area s of the dimple 8 is an area of a region surrounded by the contour line when the center of the golf ball 2 is viewed at infinity. In instances of a circular dimple 8, the area s is calculated by the following formula:

$$s=(Di/2)^2*\pi$$

In the golf ball 2 shown in FIG. 3, the area of the dimple A is 15.90 $mm^2$; the area of the dimple B is 15.20 $mm^2$; the area of the dimple C is 14.52 $mm^2$; the area of the dimple D is 13.20 $mm^2$; the area of the dimple E is 12.57 $mm^2$; the area of the dimple F is 9.62 $mm^2$; and the area of the dimple G is 7.07 $mm^2$.

In the present invention, ratio of total of the areas s of all the dimples 8 to the surface area of the phantom sphere 13 is referred to as an occupation ratio. From the standpoint that sufficient dimple effect is achieved, the occupation ratio is preferably equal to or greater than 75%, more preferably equal to or greater than 78%, and particularly preferably equal to or greater than 81%. The occupation ratio is preferably equal to or less than 90%. According to the golf ball 2 shown in FIG. 3, total area of the dimples 8 is 4500.5 $mm^2$. Because the surface area of the phantom sphere 13 of this golf ball 2 is 5728.0 $mm^2$, the occupation ratio is 78.6%.

When the diameter Di of the dimple 8 is set to be great, the dimples 8 may cross with each other. Although apparent occupation ratio of the dimples 8 is great in the golf ball 2 having numerous crossings, the effective area of the dimples 8 is small. In light of flight performance, greater effective area is more preferred as compared with the apparent occupation ratio. In other words, it is preferred that number of the crossings of the dimples 8 is smaller. Ratio (N3/N1) of number N3 of crossing adjacent dimple pairs to the number N1 is preferably equal to or less than 0.10, more preferably equal to or less than 0.08, and particularly preferably equal to or less than 0.06. Ideally, the ratio (N3/N1) is zero. In the golf ball 2 shown in FIG. 3, the number N3 is 12, and the ratio (N3/N1) is 0.013.

In light of the dimple effect, ratio (N4/N) of number N4 of the dimples 8 having a diameter of equal to or less than 3.50 mm to the total number N is preferably equal to or less than 0.20, more preferably equal to or less than 0.15, and particularly preferably equal to or less than 0.10. Ideally, the ratio (N4/N) is zero.

From the standpoint that sufficient occupation ratio can be achieved, total number of the dimples 8 is preferably equal to or greater than 200, and particularly preferably equal to or greater than 252. From the standpoint that individual dimples 8 can have a sufficient diameter, it is preferred that the total number is equal to or less than 362, further equal to or less than 360, still more equal to or less than 332, and yet more equal to or less than 328.

It is preferred that multiple types of the dimples 8 having a different diameter one another are arranged. By thus arranging multiple types of the dimples 8, great ratio (N1/N), great ratio (N2/N1), great mean diameter Da, and small ratio (N3/N1) of the golf ball 2 can be achieved. In this respect, number of the types of the dimples 8 is more preferably equal to or greater than 3, and particularly preferably equal to or greater than 4. In light of ease in manufacture of the mold, the number of the types is preferably equal to or less than 15.

According to the present invention, the term "dimple volume" means a volume of a part surrounded by a plane that includes the contour of the dimple 8 and the surface of the dimple 8. In light of possible suppression of hopping of the golf ball 2, total volume of the dimples 8 is preferably equal to or greater than 250 $mm^3$, more preferably equal to or greater than 260 $mm^3$, and particularly preferably equal to or greater than 270 $mm^3$. In light of possible suppression of dropping of the golf ball 2, the total volume is preferably equal to or less than 400 $mm^3$, more preferably equal to or less than 390 $mm^3$, and particularly preferably equal to or less than 380 $mm^3$ .

In light of possible suppression of hopping of the golf ball 2, the depth of the dimple 8 is preferably equal to or greater than 0.05 mm, more preferably equal to or greater than 0.08 mm, and particularly preferably equal to or greater than 0.10 mm. In light of possible suppression of dropping of the golf ball 2, the depth is preferably equal to or less than 0.60 mm, more preferably equal to or less than 0.45 mm, and particularly preferably equal to or less than 0.40 mm. The depth is a distance between the tangent line T and the deepest point of the dimple 8.

In the present invention, the great circle that is situated on the phantom sphere 13 and that does not cross the dimple 8 is referred to as "great circle band". When the rotation axis of the back spin is orthogonal to a plane including the great circle band, circumferential speed of the back spin becomes greatest on this great circle band. When the rotation axis of the back spin is orthogonal to a plane including the great circle band, sufficient dimple effect may not be achieved. The great circle band interferes flight performance. Further, the great circle band also interferes aerodynamic symmetry. It is preferred that the golf ball 2 does not have any great circle band.

In FIG. 3, two pole points P, two first latitude lines 14, two second latitude lines 16 and an equatorial line 18 are depicted. Latitude of the pole point P is 90°, and latitude of the equatorial line 18 is 0°. Latitude of the first latitude line 14 is greater than that of the second latitude line 16.

This golf ball 2 has a northern hemisphere N above the equatorial line 18, and a southern hemisphere S below the equatorial line 18. Each of the northern hemisphere N and the southern hemisphere S has a pole vicinity region 20, an equator vicinity region 22 and a coordination region 24. The first latitude line 14 is a boundary line between the pole vicinity region 20 and the coordination region 24. The second latitude line 16 is a boundary line between the equator vicinity region 22 and the coordination region 24. The pole vicinity region 20 is located between the pole point P and the first latitude line 14. The equator vicinity region 22 is located between the second latitude line 16 and the equatorial line 18. The coordination region 24 is located between the first latitude line 14 and the second latitude line 16. In other words, the coordination region 24 is located between the pole vicinity region 20 and the equator vicinity region 22.

With respect to the dimple 8 crossing over the first latitude line 14 or the second latitude line 16, the region to which it belongs is decided on the basis of the center position thereof. The dimple 8 which crosses over the first latitude line 14 and which has the center positioned in the pole vicinity region 20 belongs to the pole vicinity region 20. The dimple 8 which crosses over the first latitude line 14 and which has the center positioned in the coordination region 24 belongs to the coordination region 24. The dimple 8 which crosses over the second latitude line 16 and which has the center positioned in the equator vicinity region 22 belongs to the equator vicinity region 22. The dimple 8 which crosses over the second latitude line 16 and which has the center positioned in the coordination region 24 belongs to the coordination region 24.

Figure 7:
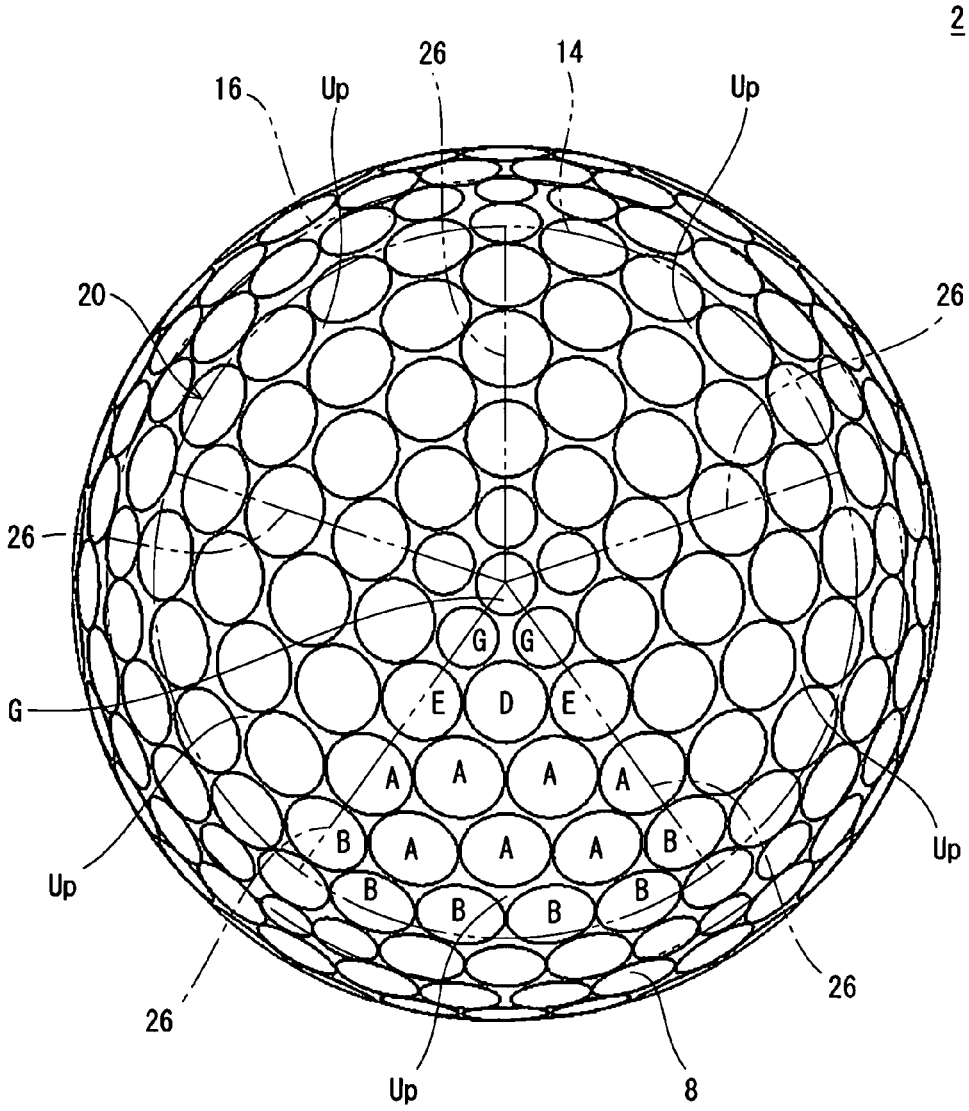
FIG. 7 is a plan view illustrating the golf ball shown in FIG. 3.
Figure 8:
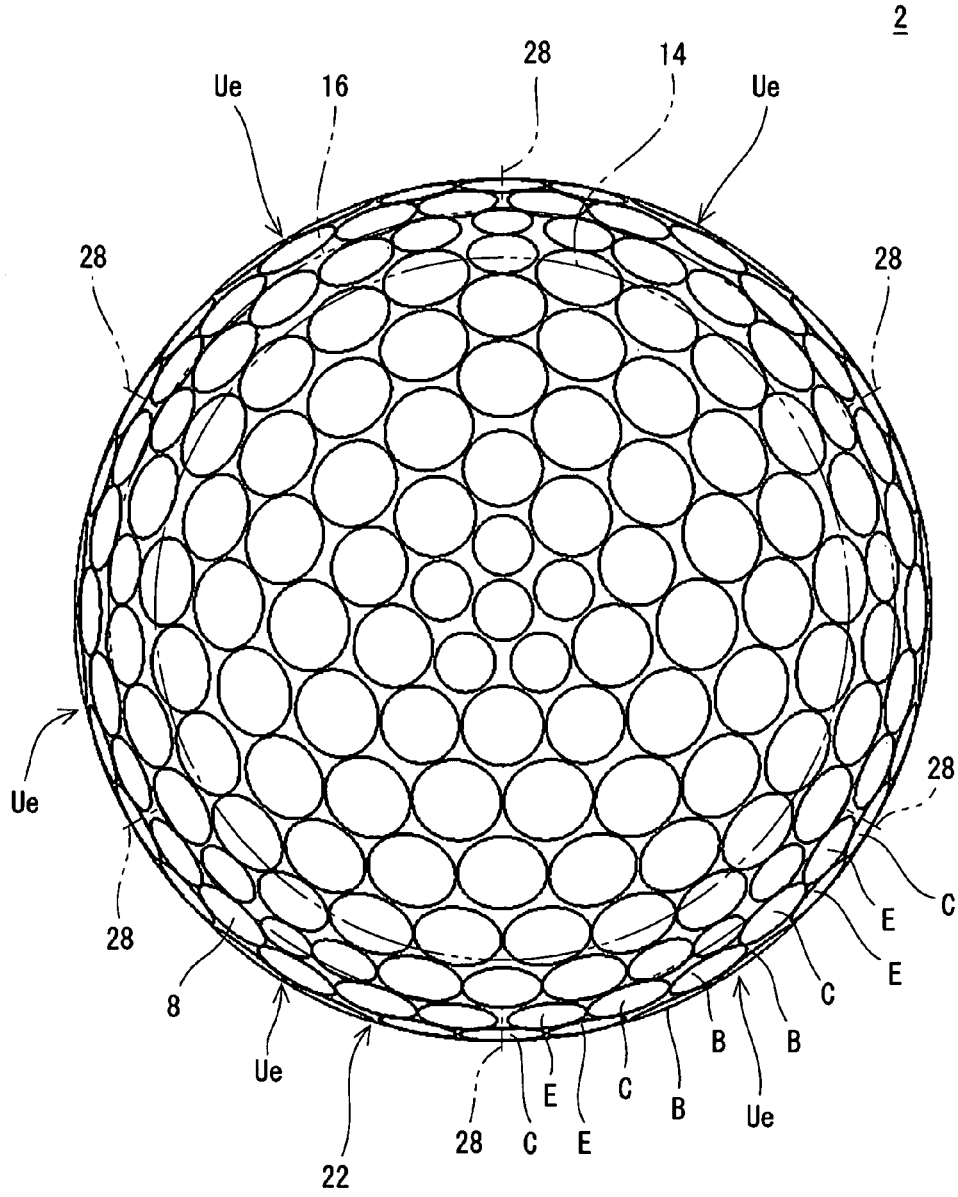
FIG. 8 is a plan view illustrating the golf ball shown in FIG. 3.
Figure 9:
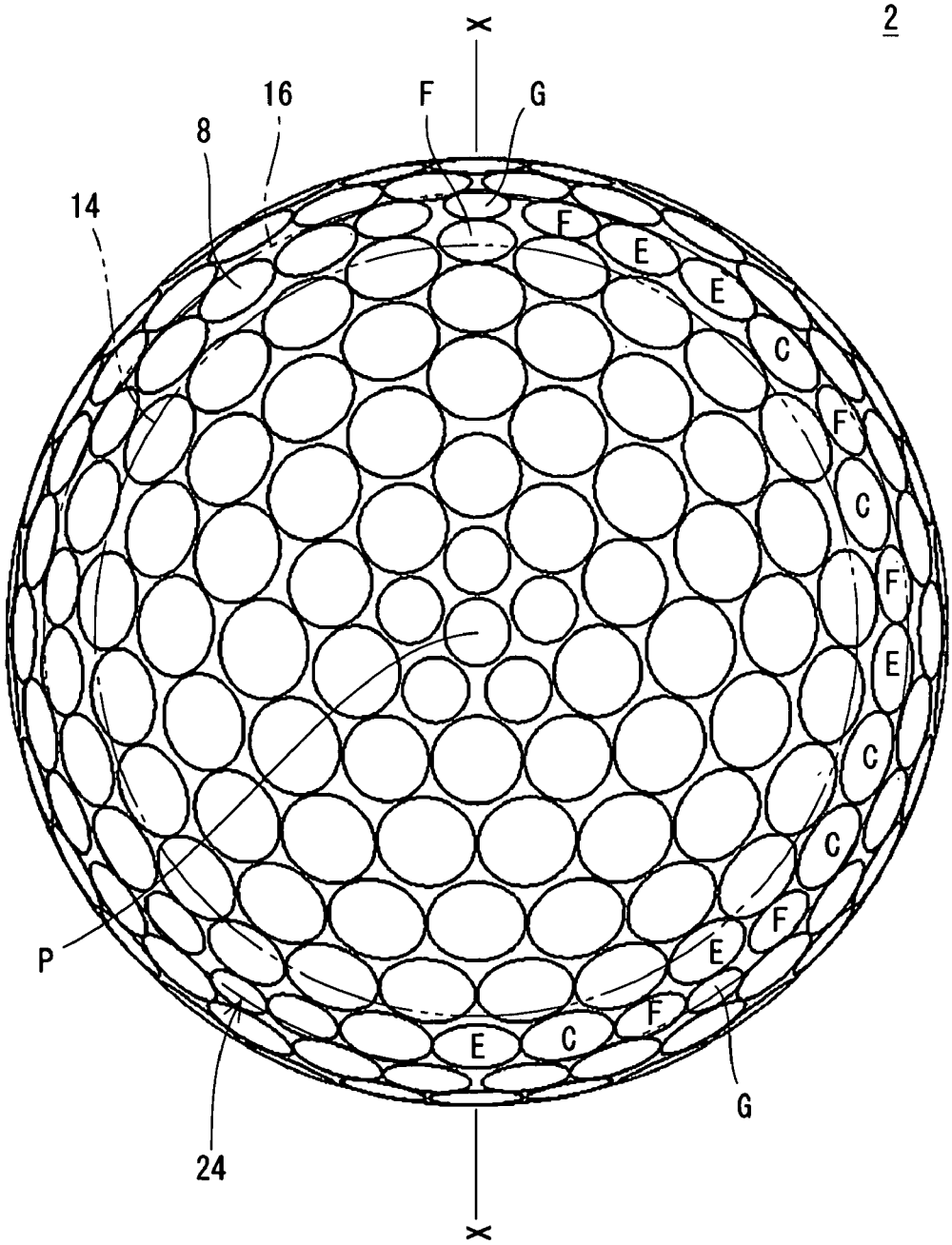
FIG. 9 is a plan view illustrating the golf ball shown in FIG. 3.

Each of FIGS. 7, 8 and 9 shows a plan view illustrating the golf ball 2 shown in FIG. 3. FIG. 7 shows five first meridian lines 26 together with the first latitude line 14 and the second latitude line 16. In this FIG. 7, the region surrounded by the first latitude line 14 is the pole vicinity region 20. The pole vicinity region 20 can be comparted into five units Up. The unit Up has a spherical triangular shape. The contour of the unit Up consists of a part of the first latitude line 14, and two first meridian lines 26. In FIG. 7, types of the dimples 8 are shown by the reference signs A, B, D, E and G with respect to one unit Up.

The dimple pattern in five units Up has rotational symmetries through 72°. In other words, when the dimple pattern in one unit Up is rotated 72° in a meridian direction around the pole point P as a center, it substantially overlaps with the dimple pattern in the adjacent unit Up. Herein, the states of "substantially overlapping" include not only the states in which the dimples 8 in one unit completely coincide with the corresponding dimples 8 in another unit, but also the states in which the dimples 8 in one unit are deviated to some extent from the corresponding dimples 8 in another unit. Herein, the states of "deviated to some extent" include the states in which the centers of the dimples 8 in one unit deviate to some extent from the centers of the corresponding dimples 8 in another unit. The distance between the center of the dimple 8 in one unit and the center of the corresponding dimple 8 in another unit is preferably equal to or less than 1.0 mm, and more preferably equal to or less than 0.5 mm. Herein, the states of "deviated to some extent" include the states in which the dimension of the dimples 8 in one unit is different to some extent from the dimension of the corresponding dimples 8 in another unit. The difference in dimension is preferably equal to or less than 0.5 mm, and particularly preferably equal to or less than 0.3 mm. The dimension means the length of the longest line segment which can be depicted over the contour of the dimple 8. In the case of a circular dimple 8, the dimension is identical with the diameter of the same.

FIG. 8 shows six second meridian lines 28 together with the first latitude line 14 and the second latitude line 16. In this FIG. 8, the external side of the second latitude line 16 corresponds to the equator vicinity region 22. The equator vicinity region 22 can be comparted into six units Ue. The unit Ue has a spherical trapezoidal shape. The contour of the unit Ue consists of a part of the second latitude line 16, two second meridian lines 28 and a part of the equatorial line 18 (see, FIG.

3). In FIG. 8, types of the dimples 8 are shown by the reference signs B, C and E with respect to one unit Ue.

The dimple pattern in six units Ue has rotational symmetries through 60°. In other words, when the dimple pattern in one unit Ue is rotated 60° in a meridian direction around the pole point P as a center, it substantially overlaps with the dimple pattern in the adjacent unit Ue. The dimple pattern in the equator vicinity region 22 can be also comparted into three units. In this instance, the dimple pattern in each unit has rotational symmetries through 120°. The dimple pattern in the equator vicinity region 22 can be also comparted into two units. In this instance, the dimple pattern in each unit has rotational symmetries through 180°. The dimple pattern in the equator vicinity region 22 has three rotation symmetry angles (i.e. 60°, 120° and 180°). In the region having multiple rotation symmetry angles, the unit Ue is decided by the compartment on the basis of the smallest rotation symmetry angle (in this case, 60°).

FIG. 9 shows the first latitude line 14 and the second latitude line 16. In this FIG. 9, the region surrounded by the first latitude line 14 and the second latitude line 16 is the coordination region 24. In FIG. 9, with respect to the dimples 8 provided in the coordination region 24, types thereof are shown by the reference signs C, E, F and G.

The dimple pattern in the coordination region 24 has a line symmetry with respect to a line X-X in a plan view. This dimple pattern does not have any axis of symmetry other than the line X-X. Rotation of greater than 0° and less than 360° around the pole point P as a center does not generate any overlap of the dimple patterns with one another. In other words, the dimple pattern in the coordination region 24 cannot be comparted into multiple units that are rotationally symmetric to each other.

The dimple pattern in the coordination region 24 which can be comparted into multiple units that are rotationally symmetric is also acceptable. In this instance, number of the units in the coordination region 24 must be different from the number of the units Up in the pole vicinity region 20, and further, must be also different from the number of the units Ue in the equator vicinity region 22.

In this golf ball 2, number Np of the units Up in the pole vicinity region 20 is 5, while number Ne of the units Ue in the equator vicinity region 22 is 6. These numbers are different from each other. The dimple pattern with the number Np and the number Ne being different from each other has great variety. According to this golf ball 2, air flow during the flight is efficiently disturbed. This golf ball 2 is excellent in flight performance. Combination (Np, Ne) of the number Np and the number Ne is not limited to (5, 6) as described above. Illustrative examples of other combination include (2, 3), (2, 4), (2, 5), (2, 6), (3, 2), (3, 4), (3, 5), (3, 6), (4, 2), (4, 3), (4, 5), (4, 6), (5, 2), (5, 3), (5, 4), (6, 2), (6, 3), (6, 4) and (6, 5).

Although detailed grounds are unknown, greater dimple effect can be achieved when one of the number Np and the number Ne is an odd number, and another is an even number, according to findings attained by the present inventors. In addition, particularly great dimple effect can be achieved when the difference between the number Np and the number Ne is 1. Illustrative examples of the combination involving this difference of 1 include (2, 3), (3, 2), (3, 4), (4, 3), (4, 5), (5, 4), (5, 6) and (6, 5).

In light of the dimple effect, it is preferred that the pole vicinity region 20 has a sufficient area, and that the equator vicinity region 22 also has a sufficient area. In light of the area of the equator vicinity region 22, latitude of the first latitude line 14 and the second latitude line 16 is preferably equal to or greater than 15°, and particularly preferably equal to or greater than 20°. In light of the area of the pole vicinity region 20, latitude of the first latitude line 14 and the second latitude line 16 is preferably equal to or less than 45°, and particularly preferably equal to or less than 40°. The first latitude line 14 can be arbitrarily selected from innumerable latitude lines. The second latitude line 16 can be also selected arbitrarily from innumerable latitude lines. In the golf ball 2 shown in FIGS. 3 and 7 to 9, the latitude of the first latitude line 14 is 42°, and the latitude of the second latitude line 16 is 30°.

In light of contribution of the pole vicinity region 20 to the dimple effect, proportion of the number of the dimples 8 that exist in the pole vicinity region 20 to the total number N of the dimples 8 is preferably equal to or greater than 20%, and particularly preferably equal to or greater than 25%. This proportion is preferably equal to or less than 45%.

In light of contribution of the equator vicinity region 22 to the dimple effect, proportion of the number of the dimples 8 that exist in the equator vicinity region 22 to the total number N of the dimples 8 is preferably equal to or greater than 30%, and particularly preferably equal to or greater than 35%. This proportion is preferably equal to or less than 65%.

Provided that the pole vicinity region 20 is adjacent to the equator vicinity region 22 across the boundary line, the dimples 8 cannot be arranged densely in the vicinity of this boundary line resulting from the difference in numbers of the units. In this case, large land 10 shall be present in the vicinity of the boundary line. The large land 10 inhibits the dimple effect. In the golf ball 2 according to the present invention, the coordination region 24 is present between the pole vicinity region 20 and the equator vicinity region 22. In this coordination region 24, the dimples 8 can be arranged without being bound by the number of the units. Thus, the area of the land 10 can be diminished. Owing to this coordination region 24, high occupation ratio is achieved.

In light of the occupation ratio, it is preferred that the coordination region 24 has a sufficient area. In this respect, the difference between the latitude of the first latitude line 14 and the latitude of the second latitude line 16 is preferably equal to or greater than 4°. When the coordination region 24 is too large, the dimple effect resulting from the difference between the number Np and the number Ne is deteriorated. In light of the dimple effect, the difference between the latitude of the first latitude line 14 and the latitude of the second latitude line 16 is preferably equal to or less than 20°, and particularly preferably equal to or less than 15°.

In light of the occupation ratio, proportion of the number of the dimples 8 that exist in the coordination region 24 to the total number of the dimples 8 is preferably equal to or greater than 5%, and particularly preferably equal to or greater than 8%. In light of the dimple effect resulting from the difference between the number Np and the number Ne, this proportion is preferably equal to or less than 24%, more preferably equal to or less than 22%, and particularly preferably equal to or less than 20%.

According to the golf ball 2 in which the pole vicinity region 20 is comparted into the units Up, and further the equator vicinity region 22 is comparted into the units Ue, period of the pattern is generated by rotation. As the number Np of the units Up and the number Ne of the units Ue are larger, the period becomes shorter. To the contrary, as the number Np and the number Ne are smaller, the period becomes longer. Adequate period may improve the dimple effect. In light of the adequate period, the number Np and the number Ne are preferably 4 or greater and 6 or less, and particularly preferably 5 or greater and 6 or less. Most preferable combination (Np, Ne) of the number Np and the number Ne is (5, 6) and (6, 5). In the golf ball 2 shown in FIG. 3 and FIGS. 6 to 8, (Np, Ne) is (5, 6).

In light of aerodynamic symmetry, it is preferred that the dimple pattern in the northern hemisphere N is equivalent to the dimple pattern in the southern hemisphere S. When a pattern that is symmetric to the dimple pattern in the northern hemisphere N with respect to the plane that includes the equatorial line 18 substantially overlaps with the dimple pattern in the southern hemisphere S, these patterns are decided to be equivalent. Also, when the pattern that is symmetric to the dimple pattern in the northern hemisphere N with respect to the plane that includes the equatorial line 18 substantially overlaps with the dimple pattern in the southern hemisphere S upon rotation thereof around the pole point P as a center, these patterns are decided to be equivalent.

According to the present invention, size of each site of the dimple 8 is measured on the golf ball 2 having a paint layer.

Figure 10:
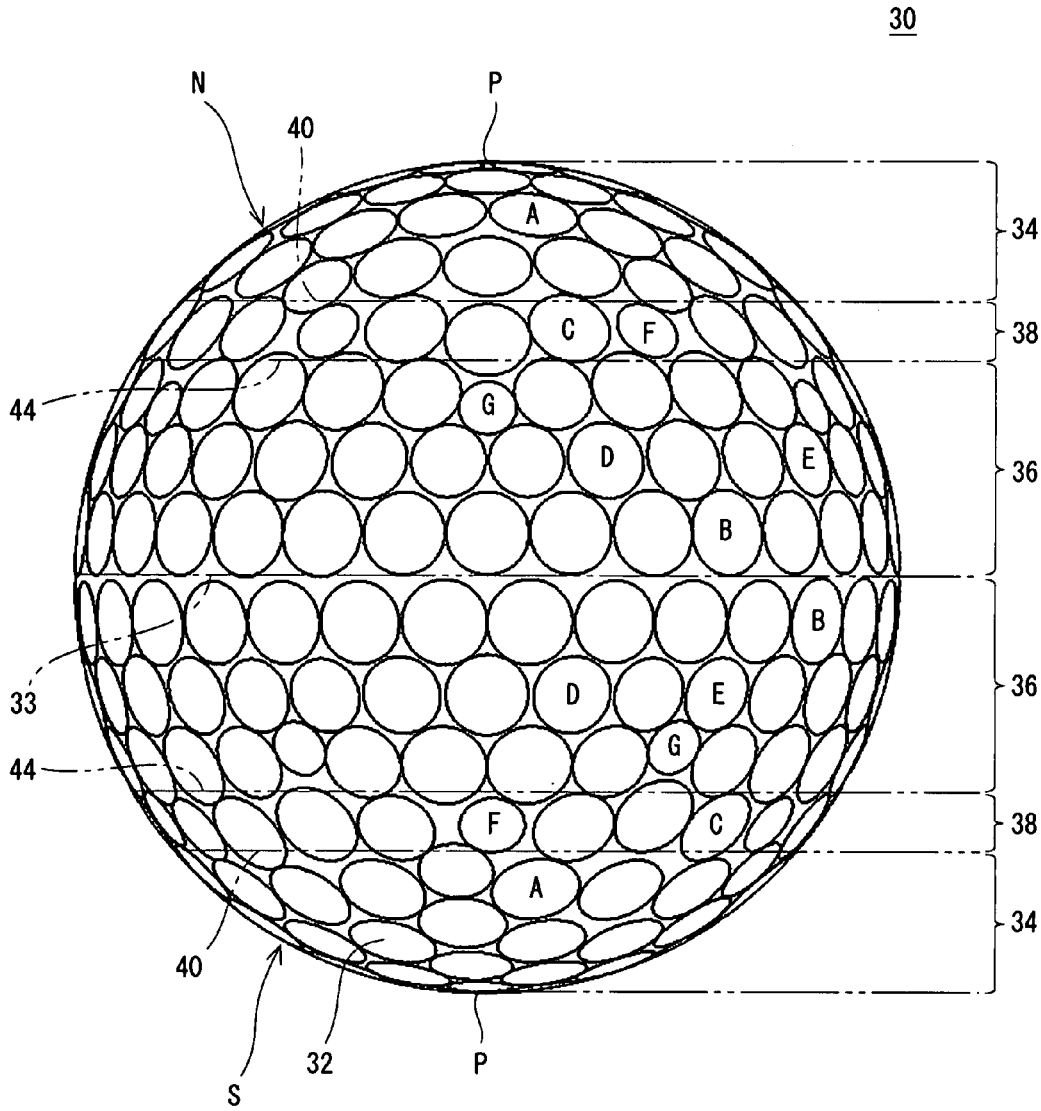
FIG. 10 is a front view illustrating a golf ball according to another embodiment of the present invention.

FIG. 10 shows a front view illustrating a golf ball 30 according to another embodiment of the present invention. In FIG. 10, types of dimples 32 are indicated by the reference signs A to G. All dimples 32 have a plane shape of circular. This golf ball 30 has dimples A having a diameter of 4.60 mm, dimples B having a diameter of 4.45 mm, dimples C having a diameter of 4.30 mm, dimples D having a diameter of 4.10 mm, dimples E having a diameter of 3.90 mm, dimples F having a diameter of 3.40 mm, and dimples G having a diameter of 3.00 mm. Number of the dimples A is 80; number of the dimples B is 60; number of the dimples C is 62; number of the dimples D is 58; number of the dimples E is 38; number of the dimples F is 18; and number of the dimples G is 14. Total number of the dimples 32 is 330.

This golf ball 30 has 1476 adjacent dimple pairs. Among them, 964 adjacent dimple pairs have a pitch of equal to or less than (Da/4), and 614 adjacent dimple pairs have a pitch of equal to or less than (Da/20). The ratio (N1/N) of the number N1 of the adjacent dimple pairs having a pitch of (Da/4) or less to the total number N of the dimples 32 is 2.92. The ratio (N2/N1) of the number N2 of the adjacent dimple pairs having a pitch of (Da/20) or less to the number N1 is 0.64. In the golf ball 30, the dimples 32 are arranged in an extremely dense manner, and the number of small dimples 32 is low. In this golf ball 30, individual dimples 32 can be responsible for the dimple effect. This golf ball 30 is excellent in flight performance.

This golf ball 30 has a mean diameter Da of 4.21 mm, and an occupation ratio of 81.1%. This golf ball 30 has seven types of the dimples 32. According to this golf ball 30, the number N3 of the crossing adjacent dimple pairs is 58, and the ratio (N3/N1) is 0.060. According to this golf ball 30, ratio (N4/N) of number N4 of the dimples 32 having a diameter of equal to or less than 3.50 mm to the total number N is 0.10. According to this golf ball 30, great ratio (N1/N), great ratio (N2/N1), great mean diameter Da, small ratio (N3/N1), and small ratio (N4/N) are achieved. This golf ball 30 is excellent in flight performance.

As shown in FIG. 10, this golf ball 30 has an equatorial line 33, a northern hemisphere N and a southern hemisphere S. The equatorial line 33 is a great circle band. Each of the northern hemisphere N and the southern hemisphere S has a pole vicinity region 34, an equator vicinity region 36 and a coordination region 38.

Figure 11:
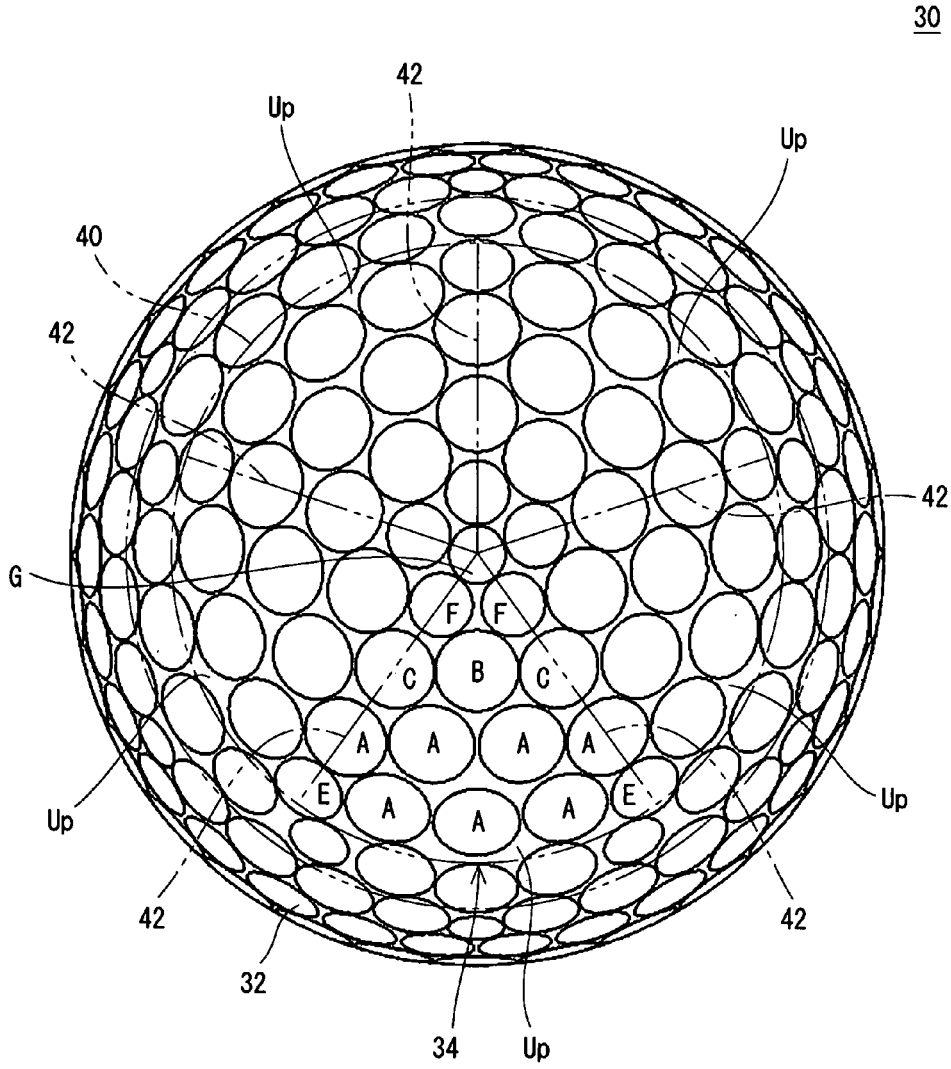
FIG. 11 is a plan view illustrating the golf ball shown in FIG. 10.
Figure 12:
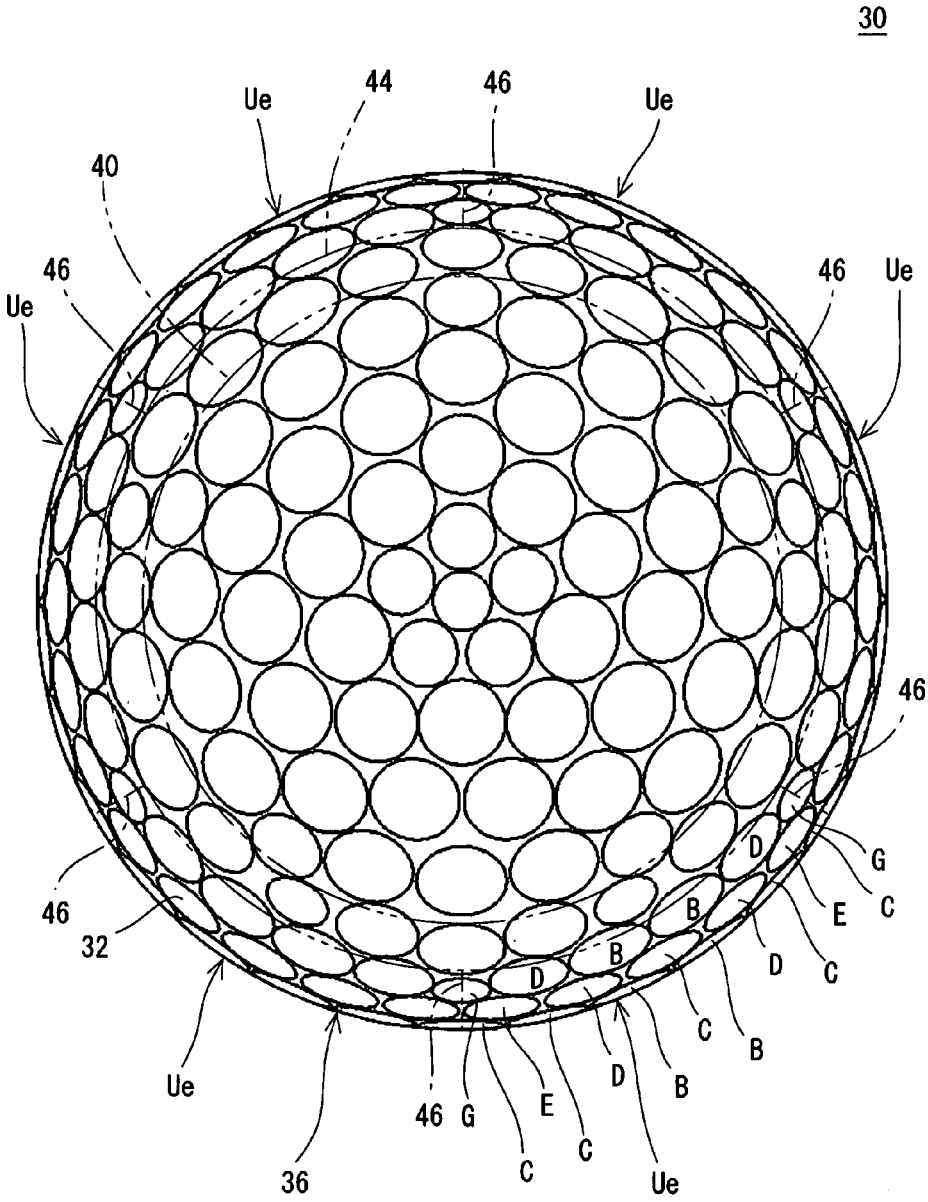
FIG. 12 is a plan view illustrating the golf ball shown in FIG. 10.
Figure 13:
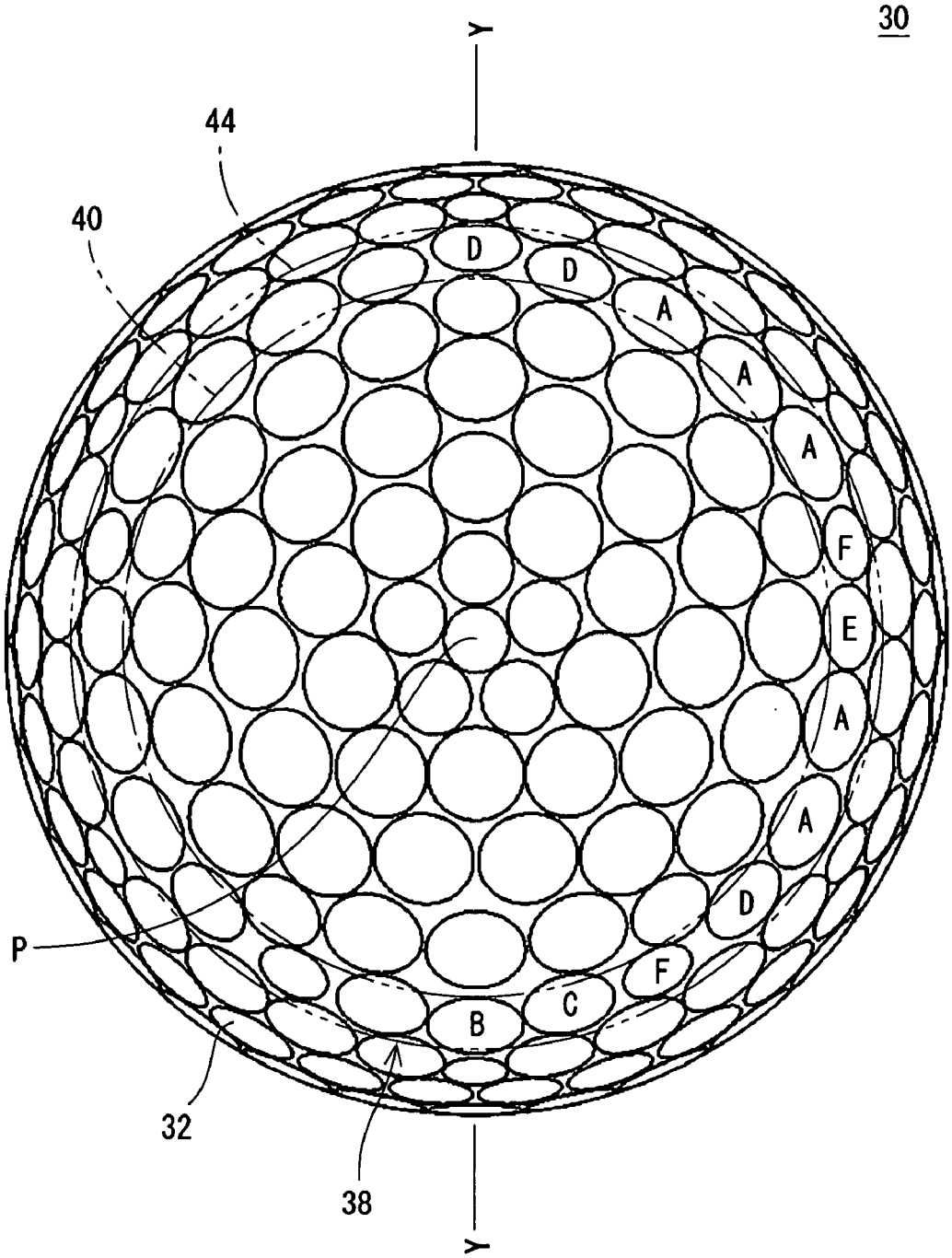
FIG. 13 is a plan view illustrating the golf ball shown in FIG. 10.

Each of FIGS. 11, 12 and 13 shows a plan view illustrating the golf ball 30 shown in FIG. 10. In FIG. 11, the region surrounded by a first latitude line 40 is the pole vicinity region 34. The pole vicinity region 34 can be comparted into five units Up. The unit Up has a spherical triangular shape. The contour of the unit Up consists of a part of the first latitude line 40, and two first meridian lines 42. In FIG. 11, types of the dimples 32 are shown by the reference signs A, B, C, E and G with respect to one unit Up. The dimple pattern in five units Up has rotational symmetries through 72°.

In FIG. 12, the external side of a second latitude line 44 corresponds to the equator vicinity region 36. The equator vicinity region 36 can be comparted into six units Ue. The unit Ue has a spherical trapezoidal shape. The contour of the unit Ue consists of a part of the second latitude line 44, two second meridian lines 46 and a part of the equatorial line 33 (see, FIG. 10). In FIG. 12, types of the dimples 32 are shown by the reference signs B, C, D, E and G with respect to one unit Ue. The dimple pattern in six units Ue has rotational symmetries through 60°.

In FIG. 13, the region surrounded by the first latitude line 40 and the second latitude line 44 is the coordination region 38. In FIG. 13, with respect to the dimples 32 provided in the coordination region 38, types thereof are shown by the reference signs A, B, C, D, E and F. The dimple pattern in the coordination region 38 has a line symmetry with respect to a line Y-Y in a plan view. This dimple pattern does not have any axis of symmetry other than the line Y-Y. Rotation of 0° or greater and less than 360° around the pole point P as a center does not generate overlap of the dimple patterns with one another. In other words, the dimple pattern in the coordination region 38 cannot be comparted into multiple units that are rotationally symmetric to each other.

In the golf ball 30 shown in FIGS. 10 to 13, the latitude of the first latitude line 40 is 35°, and the latitude of the second latitude line 44 is 21°.

In this golf ball 30, the number Np of the units Up in the pole vicinity region 34 is 5, while the number Ne of the units Ue in the equator vicinity region 36 is 6. This dimple pattern has great variety. According to this golf ball 30, the coordination region 38 is responsible for a great occupation ratio. This golf ball 30 is excellent in flight performance.

Figure 14:
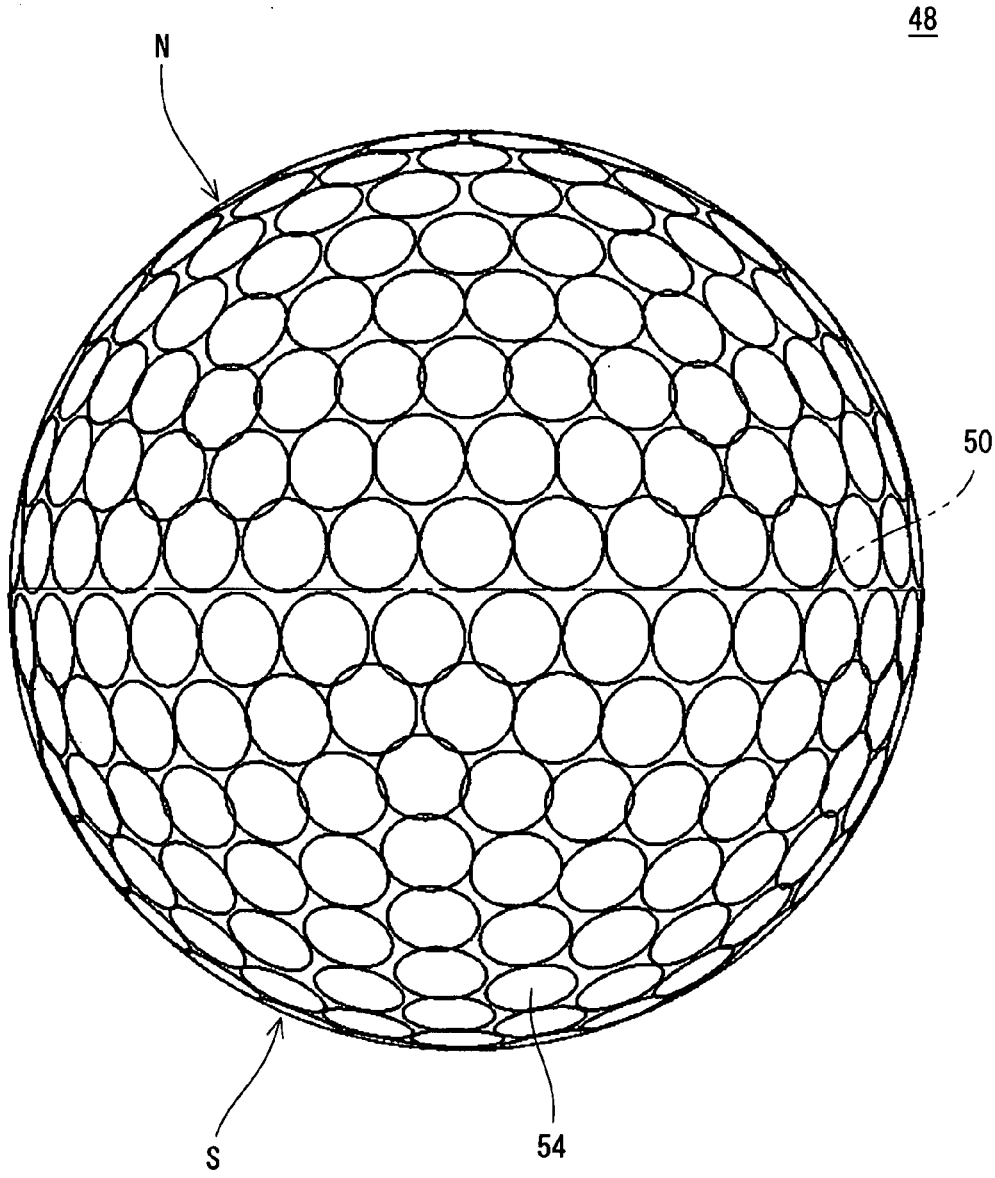
FIG. 14 is a front view illustrating a golf ball according to still another embodiment of the present invention.
Figure 15:
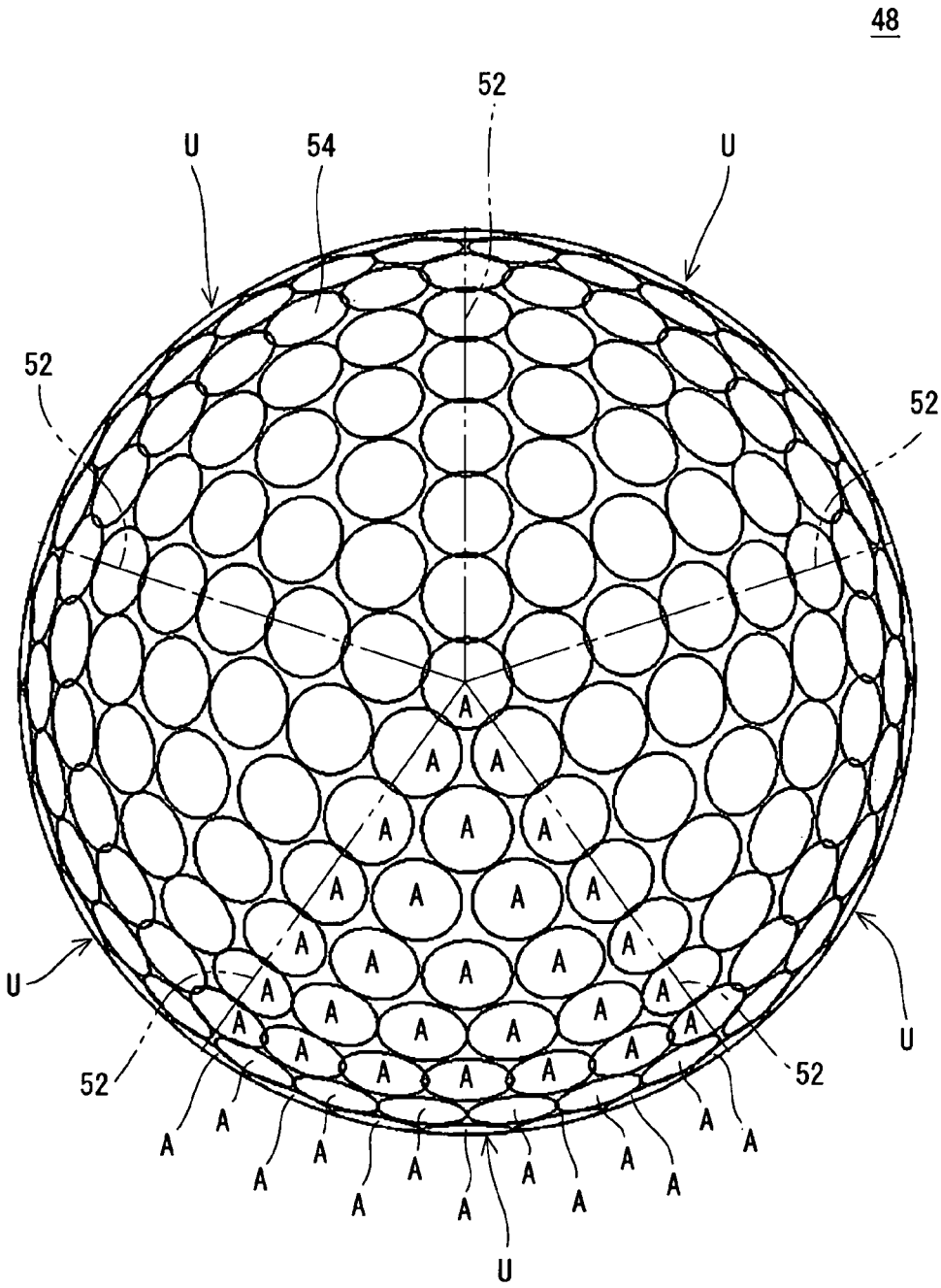
FIG. 15 is a front view illustrating the golf ball shown in FIG. 14.

FIG. 14 shows a front view illustrating a golf ball 48 according to still another embodiment of the present invention, and FIG. 15 shows a plan view of the same. As shown in FIG. 14, this golf ball 48 has an equatorial line 50, a northern hemisphere N and a southern hemisphere S. As shown in FIG. 15, each of the northern hemisphere N and the southern hemisphere S can be comparted into 5 units U. The unit U has a spherical triangular shape. The contour of the unit U consists of two meridian lines 52, and a part of the equatorial line 50 (see, FIG. 14). In FIG. 15, types of dimples 54 are shown by the reference sign A with respect to one unit U. The dimple A has a diameter of 4.318 mm. Total number N of the dimples 54 is 332. The dimple pattern in five units U has rotational symmetries through 72°.

This golf ball 48 has 1450 adjacent dimple pairs. Among them, 990 adjacent dimple pairs have a pitch of equal to or less than (Da/4), and 540 adjacent dimple pairs have a pitch of equal to or less than (Da/20). The ratio (N1/N) of the number N1 of the adjacent dimple pairs having a pitch of (Da/4) or less to the total number N of the dimples 54 is 2.98. The ratio (N2/N1) of the number N2 of the adjacent dimple pairs having a pitch of (Da/20) or less to the number N1 is 0.55. In the golf ball 48, the dimples 54 are arranged in an extremely dense manner, and the number of small dimples 54 is low. In this golf ball 48, individual dimples 54 can be responsible for the dimple effect. This golf ball 48 is excellent in flight performance.

This golf ball 48 has a mean diameter Da of 4.318 mm, and an occupation ratio of 84.9%. According to this golf ball 48, the ratio (N4/N) of the number N4 of the dimples 54 having a diameter of equal to or less than 3.50 mm to the total number N is zero. According to this golf ball 48, great ratio (N1/N), great ratio (N2/N1), great mean diameter Da, and small ratio (N4/N) are achieved.

According to this golf ball 48, the number N3 of the crossing adjacent dimple pairs is 260, and the ratio (N3/N1) is 0.263. This ratio (N3/N1) is great. According to this golf ball 48, the effective area is small as compared with the apparent occupation ratio. Small effective area is disadvantageous in light of the dimple effect. As is clear from FIG. 14, the equatorial line 50 does not cross the dimple 54. This equatorial line 54 corresponds to the great circle band. This golf ball 48 has one great circle band. The presence of the great circle band is disadvantageous in light of the dimple effect.

EXAMPLES

Example 1

A rubber composition was obtained by kneading 100 parts by weight of polybutadiene (trade name "BR-730", available from JSR Corporation) which is synthesized using a rare earth element catalyst, 33 parts by weight of zinc diacrylate, 10 parts by weight of zinc oxide, an adequate amount of barium sulfate, 0.5 part by weight of diphenyl disulfide (manufactured by Sumitomo Seika Chemicals Co., Ltd.) and 0.8 part by weight of dicumyl peroxide (manufactured by NOF Corporation). This rubber composition was placed into a mold having upper and lower mold half each having a hemispherical cavity, and heated at 170° C. for 20 minutes to obtain a center. The center had a diameter of 38.2 mm.

A resin composition was obtained by kneading 26 parts by weight of ionomer resin (the aforementioned"Surlyn® 8945"), 26 parts by weight of another ionomer resin (the aforementioned "Surlyn® 9945"), 48 parts by weight of styrene block-containing thermoplastic elastomer (the aforementioned "Rabalon® T3221C"), 1 part by weight of zinc oxide (trade name "Panatetra WZ-0501", available from Matsushita Electronic Industrial Co., Ltd. Mean length of needle-like parts: 10 μm ), 3 parts by weight of titanium dioxide and 0.1 part by weight of ultramarine blue. A mid layer was formed by covering around the center with this resin composition by injection molding. The mid layer had a thickness Tm of 1.0 mm.

A resin composition was obtained by kneading 57 parts by weight of ionomer resin (the aforementioned "Surlyn® 8945") 40 parts by weight of another ionomer resin (the aforementioned "Surlyn® 9945"), 3 parts by weight of a styrene block-containing thermoplastic elastomer (the aforementioned "Rabalon® T3221C"), 1 part by weight of zinc oxide (the aforementioned "Panatetra WZ-0501"), 3 parts by weight of titanium dioxide and 0.1 part by weight of ultramarine blue. A core comprising the center and the mid layer was placed into a final mold having numerous pimples on the inside face, followed by injection of the aforementioned resin composition around the core by injection molding to form a cover. A thickness Tc of the cover was 1.25 mm. Numerous dimples having a shape inverted from the shape of the pimples were formed on the cover. A clear paint including a two-part liquid curable polyurethane as a base was applied on this cover to give a golf ball of Example 1 having a diameter of 42.7 mm and a weight of about 45.4 g. This golf ball has a dimple pattern shown in FIG. 3 and FIGS. 7 to 9. Details of specifications of the dimples are shown in table 3 below.

Examples 2 to 4 and Comparative Examples 1 to 2

In a similar manner to example 1 except that the final mold was changed to form dimple patterns whose types are shown in tables 4 and 6 below, golf balls of examples 2 to 4 and comparative examples 1 to 2 were obtained. Details of specifications of the dimples are shown in table 3 below.

Examples 5 to 7 and Comparative Examples 3 to 8

In a similar manner to example 1 except that the specifications of the center, the mid layer and the cover were set as shown in tables 5 to 7 below, golf balls of examples 5 to 7 and comparative examples 3 to 8 were obtained. Details of compositions of the center, the mid layer and the cover are shown in tables 1 and 2 below.

[Evaluation of Feel at Impact]

Using a driver, the golf balls were hit by a high class golf player. Then, the golf player rated feel at impact based on the following criteria:

A: Extremely favorable

B: Favorable

C: Unfavorable

The results are presented in tables 4 to 7 below.

[Evaluation of Control Performance]

Using a pitching wedge, the golf balls were hit by a high class golf player. Then, the golf player rated the control performance based on the following criteria:

A: Easily spun. Favorable control performance

B: Average

C: Not easily spun. Unfavorable control performance

The results are presented in tables 4 to 7 below.

[Travel Distance Test]

A driver with a metal head was attached to a swing machine, available from True Temper Co. Then the golf ball was hit under the condition to provide a head speed of 45 m/sec and the distance from the launching point to the point where the ball stopped was measured. Mean values of 10 times measurement are presented in tables 4 to 7 below.

TABLE 1

Compositions of Core (parts by weight)

| Type | (i) | (ii) | (iii) | (iv) |
|---|---|---|---|---|
| BR-730 | 100 | 100 | 100 | 100 |
| Zinc diacrylate | 33 | 32 | 36 | 25.5 |
| Zinc oxide | 10 | 10 | 10 | 10 |
| Barium sulfate | * | * | * | * |
| Diphenyl disulfide | 0.5 | 0.5 | 0.5 | 0.5 |
| Dicumyl peroxide | 0.8 | 0.8 | 0.8 | 0.8 |

* adjusted so that golf balls have a weight of 45.4 g

TABLE 2

Composition of Mid layer and Cover (parts by weight)

| Type | (a) | (b) | (c) | (d) | (e) | (f) | (g) |
|---|---|---|---|---|---|---|---|
| Surlyn 8945 | 26 | 32 | 23 | 52 | 57 | 43 | 60 |
| Surlyn 9945 | 26 | 32 | 23 | 40 | 40 | 43 | 40 |
| Rabalon T3221C | 48 | 36 | 54 | 8 | 3 | 14 | — |
| Panatetra WZ-0501 | 1 | 1 | 1 | — | 1 | — | — |
| Titanium dioxide | 3 | 3 | 3 | 3 | 3 | 3 | 3 |
| Ultramarine blue | 0.1 | 0.1 | 0.1 | 0.1 | 0.1 | 0.1 | 0.1 |
| Hardness (Shore D) | 35 | 42 | 30 | 59 | 61 | 56 | 64 |
| Flexural rigidity (MPa) | 47 | 73 | 28 | 205 | 245 | 165 | 290 |

TABLE 3

Specifications of Dimples

Figure 16:
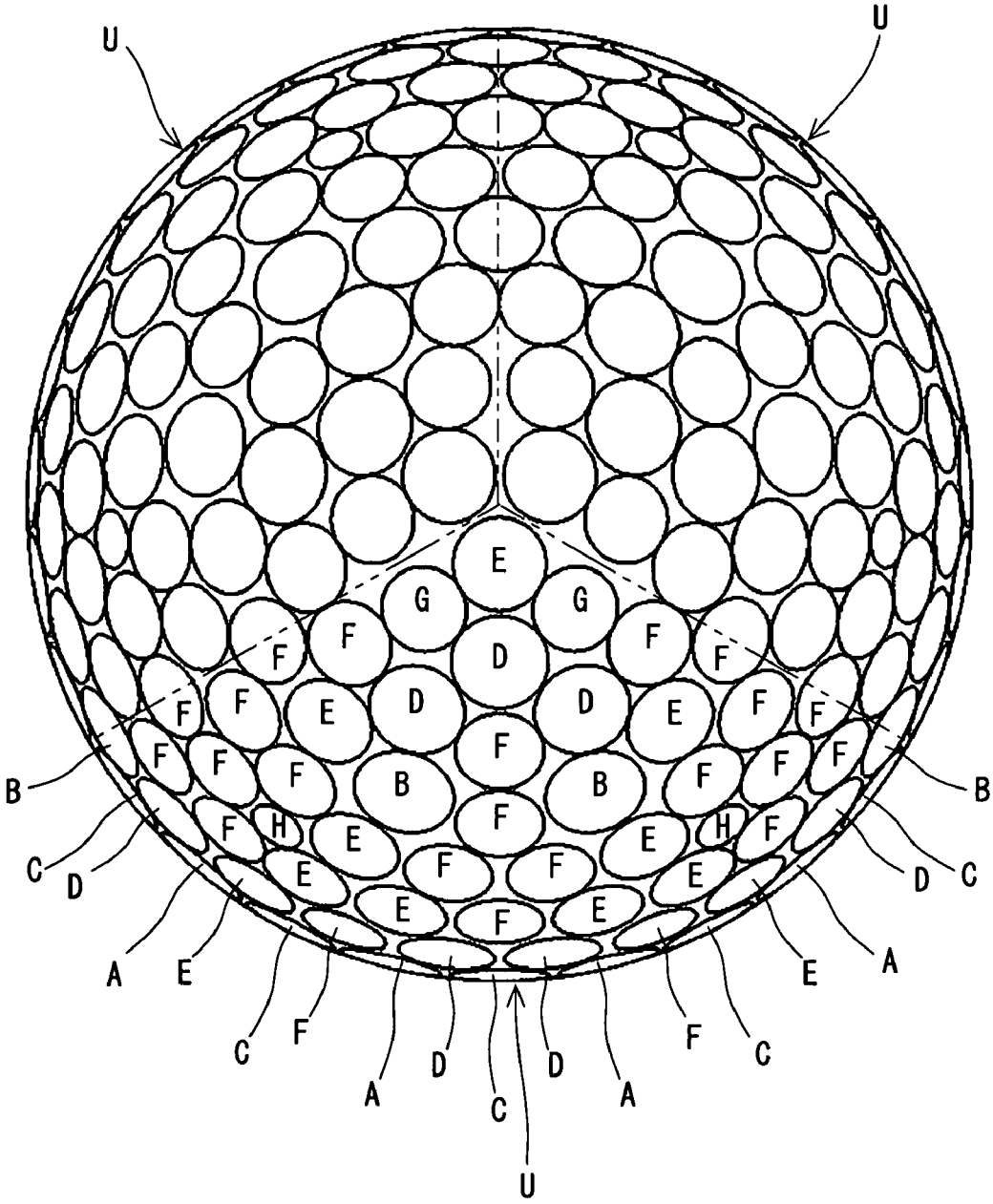
FIG. 16 is a plan view illustrating a golf ball according to comparative example 1.
Figure 17:
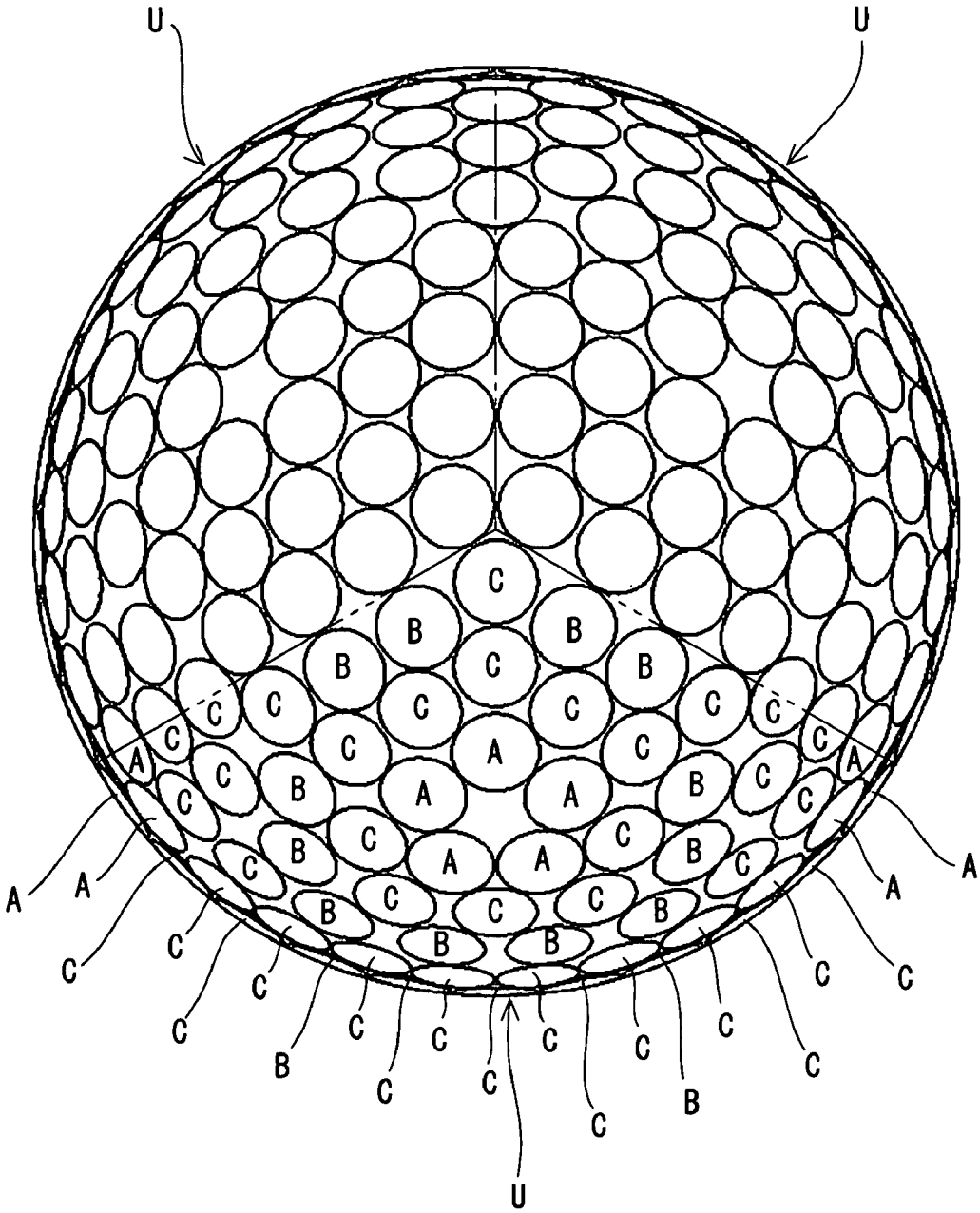
FIG. 17 is a plan view illustrating a golf ball according to comparative example 2.

| Type | Kind | Number | Diameter Di (mm) | Depth (mm) | Curvature radius (mm) | Volume ($mm^3$) | Total volume ($mm^3$) | FIG. |
|---|---|---|---|---|---|---|---|---|
| I | A | 60 | 4.500 | 0.1410 | 18.02 | 1.123 | 316.0 | FIG. 3 |
| | B | 86 | 4.400 | 0.1400 | 17.36 | 1.066 | | FIGS. 7-9 |
| | C | 56 | 4.300 | 0.1400 | 16.58 | 1.018 | | |
| | D | 10 | 4.100 | 0.1400 | 15.08 | 0.926 | | |
| | E | 76 | 4.000 | 0.1400 | 14.36 | 0.881 | | |
| | F | 22 | 3.500 | 0.1400 | 11.01 | 0.675 | | |
| | G | 18 | 3.000 | 0.1400 | 8.11 | 0.496 | | |
| II | A | 80 | 4.600 | 0.1360 | 19.52 | 1.131 | 315.9 | FIGS. 10-13 |
| | B | 60 | 4.450 | 0.1360 | 18.27 | 1.059 | | |
| | C | 62 | 4.300 | 0.1360 | 17.06 | 0.989 | | |
| | D | 58 | 4.100 | 0.1360 | 15.52 | 0.899 | | |
| | E | 38 | 3.900 | 0.1350 | 14.15 | 0.808 | | |
| | F | 18 | 3.400 | 0.1350 | 10.77 | 0.614 | | |
| | G | 14 | 3.000 | 0.1350 | 8.40 | 0.478 | | |
| III | A | 80 | 4.555 | 0.1390 | 18.73 | 1.134 | 316.2 | FIGS. 10-13 |
| | B | 60 | 4.405 | 0.1390 | 17.52 | 1.061 | | |
| | C | 62 | 4.255 | 0.1390 | 16.35 | 0.990 | | |
| | D | 58 | 4.055 | 0.1390 | 14.86 | 0.899 | | |
| | E | 38 | 3.855 | 0.1380 | 13.53 | 0.807 | | |
| | F | 18 | 3.355 | 0.1380 | 10.26 | 0.611 | | |
| | G | 14 | 2.955 | 0.1380 | 7.98 | 0.475 | | |
| IV | A | 332 | 4.318 | 0.1300 | 17.99 | 0.953 | 316.4 | FIGS. 14-15 |
| V | A | 24 | 4.700 | 0.1400 | 19.79 | 1.216 | 316.1 | FIGS. 16 |
| | B | 18 | 4.600 | 0.1400 | 18.96 | 1.165 | | |
| | C | 30 | 4.500 | 0.1390 | 18.28 | 1.107 | | |
| | D | 42 | 4.400 | 0.1390 | 17.48 | 1.058 | | |
| | E | 66 | 4.200 | 0.1390 | 15.93 | 0.964 | | |
| | F | 126 | 4.000 | 0.1390 | 14.46 | 0.875 | | |
| | G | 12 | 3.900 | 0.1390 | 13.75 | 0.832 | | |
| | H | 12 | 2.600 | 0.1390 | 6.15 | 0.370 | | |
| VI | A | 60 | 4.100 | 0.1450 | 14.56 | 0.959 | 315.9 | FIG. 17 |
| | B | 84 | 4.000 | 0.1440 | 13.96 | 0.906 | | |
| | C | 216 | 3.900 | 0.1410 | 13.55 | 0.844 | | |

TABLE 4

Results of Evaluation

| | | | Example 1 | Example 2 | Example 3 | Example 4 |
|---|---|---|---|---|---|---|
| Center | Type of composition | | (i) | (i) | (i) | (i) |
| | Diameter (mm) | | 38.2 | 38.2 | 38.2 | 38.2 |
| | Compressive deformation (mm) | | 3.0 | 3.0 | 3.0 | 3.0 |
| Mid layer | Type of composition | | (a) | (a) | (a) | (a) |
| | Thickness Tm | | 1.0 | 1.0 | 1.0 | 1.0 |
| | Volume Vm ($cm^3$) | | 4.83 | 4.83 | 4.83 | 4.83 |
| | Flexural rigidity Fm (MPa) | | 47 | 47 | 47 | 47 |
| | Pm (Vm * Fm) | | 227 | 227 | 227 | 227 |
| Cover | Type of composition | | (e) | (e) | (e) | (e) |
| | Thickness Tc (mm) | | 1.25 | 1.25 | 1.25 | 1.25 |
| | Volume Vc ($cm^3$) | | 6.75 | 6.75 | 6.75 | 6.75 |
| | Flexural rigidity Fc (MPa) | | 245 | 245 | 245 | 245 |
| | Pc (Vm * Fm) | | 1688 | 1688 | 1688 | 1688 |
| Dimple | Type | | I | II | III | IV |
| | Total number N | | 328 | 330 | 330 | 332 |
| | Mean diameter Da (mm) | | 4.16 | 4.21 | 4.17 | 4.32 |
| | Number of adjacent dimple pairs | | 1382 | 1476 | 1492 | 1450 |
| | Occupation ratio (%) | | 78.6 | 81.1 | 79.4 | 84.9 |
| | Number of great circle band | | 0 | 1 | 1 | 1 |
| | Number N1 | | 914 | 964 | 960 | 990 |
| | Ratio (N1/N) | | 2.79 | 2.92 | 2.91 | 2.98 |
| | Number N2 | | 546 | 614 | 514 | 540 |
| | Ratio (N2/N1) | | 0.60 | 0.64 | 0.54 | 0.55 |
| | Number N3 | | 12 | 58 | 0 | 260 |
| | Ratio (N3/N1) | | 0.013 | 0.060 | 0 | 0.263 |
| | Pole vicinity region | Rotation symmetry angle (deg.) | 72 | 72 | 72 | — |
| | | Number of units Np | 5 | 5 | 5 | — |

TABLE 4-continued

| Results of Evaluation | | | Example 1 | Example 2 | Example 3 | Example 4 |
|---|---|---|---|---|---|---|
| | Coordination region | | Line symmetry | Line symmetry | Line symmetry | — |
| | Equator Vicinity region | Rotation symmetry angle (deg.) | 60 | 60 | 60 | — |
| | | Number of units Ne | 6 | 6 | 6 | — |
| | Northern and southern hemispheres | Rotation symmetry angle (deg.) | — | — | — | 120 |
| | | Number of units | — | — | — | 3 |
| Pm + Pc | | | 1915 | 1915 | 1915 | 1915 |
| Pc/Pm | | | 7.4 | 7.4 | 7.4 | 7.4 |
| Compressive deformation of ball (mm) | | | 2.5 | 2.5 | 2.5 | 2.5 |
| Feel at impact | | | A | A | A | A |
| Control performance | | | A | A | A | A |
| Flight distance (m) | | | 247 | 248 | 246 | 244 |

TABLE 5

| Results of Evaluation | | | Example 5 | Example 6 | Example 7 |
|---|---|---|---|---|---|
| Center | Type of composition | | (i) | (iii) | (iv) |
| | Diameter (mm) | | 38.2 | 38.2 | 38.2 |
| | Compressive deformation (mm) | | 3.0 | 2.6 | 4.1 |
| Mid layer | Type of composition | | (a) | (a) | (a) |
| | Thickness Tm | | 1.0 | 1.0 | 1.0 |
| | Volume Vm ($cm^3$) | | 4.83 | 4.83 | 4.83 |
| | Flexural rigidity Fm (MPa) | | 47 | 47 | 47 |
| | Pm (Vm * Fm) | | 227 | 227 | 227 |
| Cover | Type of composition | | (d) | (d) | (d) |
| | Thickness Tc (mm) | | 1.25 | 1.25 | 1.25 |
| | Volume Vc ($cm^3$) | | 6.75 | 6.75 | 6.75 |
| | Flexural rigidity Fc (MPa) | | 205 | 205 | 205 |
| | Pc (Vm * Fm) | | 1412 | 1412 | 1412 |
| Dimple | Type | | I | I | I |
| | Total number N | | 328 | 328 | 328 |
| | Mean diameter Da (mm) | | 4.16 | 4.16 | 4.16 |
| | Number of adjacent dimple pairs | | 1382 | 1382 | 1382 |
| | Occupation ratio (%) | | 78.6 | 78.6 | 78.6 |
| | Number of great circle band | | 0 | 0 | 0 |
| | Number N1 | | 914 | 914 | 914 |
| | Ratio (N1/N) | | 2.79 | 2.79 | 2.79 |
| | Number N2 | | 546 | 546 | 546 |
| | Ratio (N2/N1) | | 0.60 | 0.60 | 0.60 |
| | Number N3 | | 12 | 12 | 12 |
| | Ratio (N3/N1) | | 0.013 | 0.013 | 0.013 |
| | Pole vicinity region | Rotation symmetry angle (deg.) | 72 | 72 | 72 |
| | | Number of units Np | 5 | 5 | 5 |
| | Coordination region | | Line symmetry | Line symmetry | Line symmetry |
| | Equator vicinity region | Rotation symmetry angle (deg.) | 60 | 60 | 60 |
| | | Number of units Ne | 6 | 6 | 6 |
| | Northern and southern hemispheres | Rotation symmetry angle (deg.) | — | — | — |
| | | Number of units | — | — | — |
| Pm + Pc | | | 1639 | 1639 | 1639 |
| Pc/Pm | | | 6.2 | 6.2 | 6.2 |
| Compressive deformation of ball (mm) | | | 2.6 | 2.2 | 3.4 |
| Feel at impact | | | A | B | A |
| Control performance | | | A | A | A |
| Flight distance (m) | | | 246 | 247 | 245 |

TABLE 6

| | | | Results of Evaluation | | | |
|---|---|---|---|---|---|---|
| | | | Comp. Example 1 | Comp. Example 2 | Comp. Example 3 | Comp. Example 4 |
| Center | Type of composition | | (i) | (i) | (i) | (i) |
| | Diameter (mm) | | 38.2 | 38.2 | 38.2 | 38.2 |
| | Compressive deformation (mm) | | 3.0 | 3.0 | 3.0 | 3.0 |
| Mid layer | Type of composition | | (a) | (a) | (a) | (b) |
| | Thickness Tm | | 1.0 | 1.0 | 1.0 | 1.0 |
| | Volume Vm ($cm^3$) | | 4.83 | 4.83 | 4.83 | 4.83 |
| | Flexural rigidity Fm (MPa) | | 47 | 47 | 47 | 73 |
| | Pm (Vm * Fm) | | 227 | 227 | 227 | 353 |
| Cover | Type of composition | | (e) | (e) | (g) | (d) |
| | Thickness Tc (mm) | | 1.25 | 1.25 | 1.25 | 1.25 |
| | Volume Vc ($cm^3$) | | 6.75 | 6.75 | 6.75 | 6.75 |
| | Flexural rigidity Fc (MPa) | | 245 | 245 | 290 | 205 |
| | Pc (Vm * Fm) | | 1688 | 1688 | 1998 | 1412 |
| Dimple | Type | | V | VI | I | I |
| | Total number N | | 330 | 360 | 328 | 328 |
| | Mean diameter Da (mm) | | 4.17 | 3.96 | 4.16 | 4.16 |
| | Number of adjacent dimple pairs | | 1410 | 1410 | 1382 | 1382 |
| | Occupation ratio (%) | | 79.2 | 77.3 | 78.6 | 78.6 |
| | Number of great circle band | | 1 | 1 | 0 | 0 |
| | Number N1 | | 960 | 954 | 914 | 914 |
| | Ratio (N1/N) | | 2.91 | 2.65 | 2.79 | 2.79 |
| | Number N2 | | 462 | 600 | 546 | 546 |
| | Ratio (N2/N1) | | 0.48 | 0.63 | 0.60 | 0.60 |
| | Number N3 | | 42 | 24 | 12 | 12 |
| | Ratio (N3/N1) | | 0.044 | 0.025 | 0.013 | 0.013 |
| | Pole vicinity region | Rotation symmetry angle (deg.) | — | — | 72 | 72 |
| | | Number of units Np | — | — | 5 | 5 |
| | Coordination region | | — | — | Line symmetry | Line symmetry |
| | Equator vicinity region | Rotation symmetry angle (deg.) | — | — | 60 | 60 |
| | | Number of units Ne | — | — | 6 | 6 |
| | Northern and southern hemispheres | Rotation symmetry angle (deg.) | 120 | 120 | — | — |
| | | Number of units | 3 | 3 | — | — |
| Pm + Pc | | | 1915 | 1915 | 2225 | 1765 |
| Pc/Pm | | | 7.4 | 7.4 | 8.8 | 4.0 |
| Compressive deformation of ball (mm) | | | 2.5 | 2.5 | 2.4 | 2.5 |
| Feel at impact | | | A | A | C | C |
| Control performance | | | A | A | C | A |
| Flight distance (m) | | | 242 | 242 | 248 | 243 |

TABLE 7

| | | Results of Evaluation | | | |
|---|---|---|---|---|---|
| | | Comp. Example 5 | Comp. Example 6 | Comp. Example 7 | Comp. Example 8 |
| Center | Type of composition | (i) | (i) | (i) | (ii) |
| | Diameter (mm) | 38.2 | 38.2 | 37.6 | 37.6 |
| | Compressive deformation (mm) | 3.0 | 3.0 | 3.0 | 3.0 |
| Mid layer | Type of composition | (a) | (c) | (a) | (a) |
| | Thickness Tm | 1.0 | 1.0 | 1.3 | 1.0 |
| | Volume Vm ($cm^3$) | 4.83 | 4.83 | 6.18 | 4.68 |
| | Flexural rigidity Fm (MPa) | 47 | 28 | 47 | 47 |
| | Pm (Vm * Fm) | 227 | 135 | 290 | 220 |
| Cover | Type of composition | (f) | (d) | (d) | (d) |
| | Thickness Tc (mm) | 1.25 | 1.25 | 1.25 | 1.55 |
| | Volume Vc ($cm^3$) | 6.75 | 6.75 | 6.75 | 8.25 |
| | Flexural rigidity Fc (MPa) | 165 | 205 | 205 | 205 |
| | Pc (Vm * Fm) | 1137 | 1412 | 1412 | 1720 |
| Dimple | Type | I | I | I | I |
| | Total number N | 328 | 328 | 328 | 328 |
| | Mean diameter Da (mm) | 4.16 | 4.16 | 4.16 | 4.16 |
| | Number of adjacent dimple pairs | 1382 | 1382 | 1382 | 1382 |
| | Occupation ratio (%) | 78.6 | 78.6 | 78.6 | 78.6 |
| | Number of great circle band | 0 | 0 | 0 | 0 |
| | Number N1 | 914 | 914 | 914 | 914 |
| | Ratio (N1/N) | 2.79 | 2.79 | 2.79 | 2.79 |

TABLE 7-continued

| | | Results of Evaluation | | | |
|---|---|---|---|---|---|
| | | Comp. Example 5 | Comp. Example 6 | Comp. Example 7 | Comp. Example 8 |
| Number N2 | | 546 | 546 | 546 | 546 |
| Ratio (N2/N1) | | 0.60 | 0.60 | 0.60 | 0.60 |
| Number N3 | | 12 | 12 | 12 | 12 |
| Ratio (N3/N1) | | 0.013 | 0.013 | 0.013 | 0.013 |
| Pole vicinity region | Rotation symmetry angle (deg.) | 72 | 72 | 72 | 72 |
| | Number of units Np | 5 | 5 | 5 | 5 |
| Coordination region | | Line symmetry | Line symmetry | Line symmetry | Line symmetry |
| Equator vicinity region | Rotation symmetry angle (deg.) | 60 | 60 | 60 | 60 |
| | Number of units Ne | 6 | 6 | 6 | 6 |
| Northern and southern hemispheres | Rotation symmetry angle (deg.) | — | — | — | — |
| | Number of units | — | — | — | — |
| Pm + Pc | | 1364 | 1548 | 1703 | 1940 |
| Pc/Pm | | 5.0 | 10.4 | 4.9 | 7.8 |
| Compressive deformation of ball (mm) | | 2.7 | 2.7 | 2.5 | 2.7 |
| Feel at impact | | A | A | A | B |
| Control performance | | A | A | A | A |
| Flight distance (m) | | 241 | 242 | 243 | 243 |

As shown in tables 4 to 7, golf balls in examples are excellent in feel at impact, control performance and flight performance. Accordingly, advantages of the present invention are clearly indicated by this result of evaluation.

The description herein above is merely for illustrative examples, and various modifications can be made without departing from the principles of the present invention.

What is claimed is:

1. A golf ball comprising a center, a mid layer positioned outside of the center, a cover positioned outside of the mid layer and numerous dimples formed on a surface of the cover, wherein a product Pm of a volume Vm ($cm^3$) multiplied by a flexural rigidity Fm (Mpa) in the mid layer and a product Pc of a volume Vc ($cm^3$) multiplied by a flexural rigidity Fc (MPa) in the cover meet the following formulae (I) and (II), $$1400<(Pm+Pc)<2000 \quad \text{(I)}$$

$$5.0<(Pc/Pm)<7.6 \quad \text{(II)},$$

provided that mean diameter of all the dimples is Da, a ratio (N1/N) of a number N1 of adjacent dimple pairs having a pitch of (Da/4) or less to a total number N of the dimples is equal to or greater than 2.70, a ratio (N2/N1) of a number N2 of the adjacent dimple pairs having a pitch of (Da/20) or less to the number N1 is equal to or greater than 0.50, and a ratio (N3/N1) of a number N3 of crossing adjacent dimple pairs to the number N1 is equal to or lesser than 0.06.

2. The golf ball according to claim 1 wherein a thickness Tm of the mid layer is equal to or less than 1.2 mm, a thickness of the cover Tc is equal to or less than 1.4 mm and a total thickness (Tm+Tc) is equal to or less than 2.4 mm.

3. The golf ball according to claim 1 wherein the mid layer has a hardness (Shore D) of 32 or greater and 39 or less.

4. The golf ball according to claim 1 wherein the ratio (N2/N1) is equal to or greater than 0.60.

5. The golf ball according to claim 1 wherein the mean diameter Da is equal to or greater than 4.00 mm, the total number N of the dimples is equal to or less than 362, and a proportion of a total area of all dimples to a surface area of a phantom sphere is equal to or greater than 75%.

6. The golf ball according to claim 1 wherein each of a northern hemisphere and a southern hemisphere of a surface of the golf ball has a pole vicinity region, an equator vicinity region and a coordination region which is located between the pole vicinity region and the equator vicinity region, a dimple pattern in the pole vicinity region includes multiple units which are rotationally symmetric to each other centered on a pole point, a dimple pattern in the equator vicinity region includes multiple units which are rotationally symmetric to each other centered on the pole point, a number of the units in the pole vicinity region is different from a number of the units in the equator vicinity region, a dimple pattern in the coordination region is either a pattern which cannot be comparted into multiple units that are rotationally symmetric to each other centered on the pole point, or a pattern including multiple units that are rotationally symmetric to each other centered on the pole point with a number of the units being different from numbers of the units in the pole vicinity region and the equator vicinity region.

7. The golf ball according to claim 1 wherein any great circle that does not cross the dimple is not present on the surface of the golf ball.

8. The golf ball according to claim 1 wherein the ratio (N1/N) is equal to or greater than 2.90 and equal to or less than 4.00; and wherein the ratio (N2/N1) is equal to or greater than 0.64 and equal to or less than 1.00.

9. The golf ball according to claim 1 wherein the ratio (N4/N) of a number N4 of dimples having a diameter of equal to or less than 3.50 mm to the total number N is equal to or less than 0.20.

* * * * *